US011158980B2

(12) United States Patent
Anderson et al.

(10) Patent No.: US 11,158,980 B2
(45) Date of Patent: Oct. 26, 2021

(54) MODULAR TELECOMMUNICATIONS PLUG AND METHOD

(71) Applicant: CommScope Technologies LLC, Hickory, NC (US)

(72) Inventors: Timothy W. Anderson, Omaha, NE (US); Jeffrey Allan Oberski, Lucas, TX (US); Brian J. Fitzpatrick, McKinney, TX (US); Shawn Phillip Tobey, Trinity, NC (US)

(73) Assignee: COMMSCOPE TECHNOLOGIES LLC, Hickory, NC (US)

( * ) Notice: Subject to any disclaimer, the term of this patent is extended or adjusted under 35 U.S.C. 154(b) by 0 days.

(21) Appl. No.: 16/697,572

(22) Filed: Nov. 27, 2019

(65) Prior Publication Data

US 2020/0176932 A1 Jun. 4, 2020

Related U.S. Application Data

(60) Provisional application No. 62/773,792, filed on Nov. 30, 2018.

(51) Int. Cl.
*H01R 13/6463* (2011.01)
*H01R 13/514* (2006.01)
*H01R 24/64* (2011.01)

(52) U.S. Cl.
CPC ..... *H01R 13/6463* (2013.01); *H01R 13/514* (2013.01); *H01R 24/64* (2013.01)

(58) Field of Classification Search
CPC .. H01R 13/6463; H01R 13/514; H01R 13/64; H01R 13/6461; H01R 13/646; H01R 13/46; H01R 13/42; H01R 13/40
USPC ..... 439/676
See application file for complete search history.

(56) References Cited

U.S. PATENT DOCUMENTS 5,888,100 A * 3/1999 Bofill ..... H01R 24/64 439/676
5,899,770 A 5/1999 Ezawa
6,056,586 A * 5/2000 Lin ..... H01R 13/506 439/460
6,109,954 A 8/2000 Lin
(Continued)

FOREIGN PATENT DOCUMENTS

CN 1131828 A 9/1996
EP 1014498 A2 6/2000
(Continued)

OTHER PUBLICATIONS

International Search Report and Written Opinion of the International Searching Authority, PCT/US2019/063636, dated Mar. 27, 2020, 14 pages.
(Continued)

*Primary Examiner* — Harshad C Patel
(74) *Attorney, Agent, or Firm* — Merchant & Gould P.C.

(57) ABSTRACT

A modular plug is disclosed as having a housing, a wire manager, a load bar, and a rear component each configured to snap-fit together to assemble the modular plug. The wire manager has a plurality of channels axially positioned about a central axis, each channel being configured to receive a twisted pair of wires from a telecommunications cable, and each channel having a first width and a gate having a second width smaller than the first width.

27 Claims, 33 Drawing Sheets

(56) References Cited

U.S. PATENT DOCUMENTS 6,238,231 B1 * 5/2001 Chapman ..... H01R 13/5829 439/395
6,250,949 B1 6/2001 Lin
6,280,232 B1 8/2001 Beecher et al.
6,358,092 B1 3/2002 Siemon et al.
6,402,559 B1 6/2002 Marowsky et al.
6,409,535 B1 6/2002 Marowsky et al.
6,506,077 B2 1/2003 Nagel
6,565,262 B2 5/2003 Childers et al.
6,579,116 B2 6/2003 Brennan et al.
6,729,901 B2 5/2004 Aekins
6,811,445 B2 11/2004 Caveney et al.
7,018,241 B2 3/2006 Caveney et al.
7,168,994 B2 1/2007 Caveney et al.
7,220,149 B2 5/2007 Pharney
7,223,112 B2 5/2007 AbuGhazaleh et al.
7,294,012 B2 11/2007 AbuGhazaleh et al.
7,374,450 B1 5/2008 Chang
7,384,298 B2 * 6/2008 Caveney ..... H01R 13/58 439/404
7,404,739 B2 * 7/2008 Sheilds ..... H01R 4/2441 439/290
7,438,583 B2 10/2008 AbuGhazaleh et al.
7,556,536 B2 7/2009 Caveney et al.
7,621,772 B1 * 11/2009 Tobey ..... H01R 13/58 174/660
7,874,865 B2 * 1/2011 Tobey ..... H01R 13/5837 439/460
7,972,183 B1 7/2011 Lin
8,277,260 B2 10/2012 Caveney et al.
8,348,702 B2 1/2013 Lin
8,702,453 B2 4/2014 Caveney et al.
9,054,440 B2 6/2015 Taylor et al.
9,214,759 B2 12/2015 Mattson et al.
9,413,154 B2 8/2016 Taylor et al.
9,448,370 B2 9/2016 Xue et al.
10,411,398 B2 * 9/2019 Pepe ..... H01R 13/562
2002/0048990 A1 4/2002 Marowsky et al.
2002/0142644 A1 10/2002 Aekins
2005/0106929 A1 5/2005 Meckley et al.
2006/0189200 A1 8/2006 Ma
2011/0053431 A1 * 3/2011 Bopp ..... H01R 13/6464 439/676
2012/0315786 A1 12/2012 Lin
2013/0052860 A1 2/2013 Caveney et al.
2013/0157500 A1 6/2013 Mattson et al.
2015/0207283 A1 7/2015 Guitard et al.
2015/0295350 A1 10/2015 Bragg
2015/0340823 A1 * 11/2015 Stanislaw ..... H01R 24/64 439/404
2016/0036179 A1 * 2/2016 Bragg ..... H01R 24/64 439/391
2018/0226743 A1 8/2018 Pepe et al.
2018/0226753 A1 * 8/2018 Patel ..... H01R 13/6467

FOREIGN PATENT DOCUMENTS

EP 1188204 B1 8/2008
WO 2005048412 A1 5/2005

OTHER PUBLICATIONS

International Search Report and Written Opinion of the International Searching Authority, PCT/US2020/041617, dated Nov. 5, 2020, 12 pages.

* cited by examiner

MODULAR TELECOMMUNICATIONS PLUG AND METHOD

CROSS-REFERENCE TO RELATED APPLICATIONS

This application claims priority to U.S. Patent Application No. 62/773,792 filed on Nov. 30, 2018, the disclosure of which is incorporated herein by reference in its entirety.

BACKGROUND

In the field of data communications, communications networks typically utilize telecommunications cable lines designed to maintain the integrity of signals being transmitted via the network. Telecommunications cable lines are typically connected into port or jack terminals using connector plugs that enable the cables to be easily connected and disconnected. The cable lines are typically comprised of twisted pairs of wires surrounded by a cable jacket. Quick connect cables are often constructed by securing a connector plug to the ends of the twisted wire pairs and sliding the connector plug into a matching port terminal where it locks into place with a simple lever lock. An RJ45 type connector is one example.

Crosstalk can negatively affect signal integrity in the telecommunications cable lines. Crosstalk is unbalanced noise caused by capacitive and/or inductive coupling between parallel wires. Furthermore, existing connector plug arrangements can be difficult to terminate in the field. For these and other reasons, improvements are desirable.

SUMMARY

One aspect relates to a modular plug for terminating a telecommunications cable. The modular plug includes a housing having an internal cavity. A wire manager is fitted inside the internal cavity, and the wire manager has a body defining a plurality of channels axially positioned about a central axis. Each channel is configured to receive a twisted pair of wires from a telecommunications cable, and each channel has a first width and a gate having a second width smaller than the first width. A load bar is fitted within the internal cavity of the housing. The load bar has an array of external grooves, each external groove being configured to receive a wire, and a plurality of wire contacts are aligned with the array of external grooves.

Each gate may include opposing sloped surfaces that are angled in converging directions with respect to the central axis. Each gate may further include opposing parallel surfaces that are substantially parallel to the central axis. In some examples, the second width of each gate is equal to or less than the diameter of a single wire from each twisted pair of wires. In some further examples, each gate is configured to hold a twisted pair of wires from the telecommunications cable in a stacked horizontal arrangement. Each channel may include at least one slit that permits each channel to flex around a twisted pair of wires.

In one example, the wire manager includes tabs configured to latch onto corresponding notches on the load bar. In another example, the wire manager includes four channels. In some examples, each channel has a circular cross-section.

The load bar may include an internal cavity having a top surface and a bottom surface that converge into the array of external grooves. The top surface and the bottom surface each include internal grooves that funnel into the array of external grooves. In one example, the array of external grooves on the load bar are parallel and are arranged in the same vertical plane. The load bar may include tabs configured to snap-fit into corresponding slots in the housing.

The modular plug may further include a rear component configured to fit around a protective outer jacket of the telecommunications cable and to attach to the housing, the rear component having tabs configured to snap-fit into corresponding slots in the housing. The rear component may further include: an opening; internal surfaces having at least one internal ratcheting rib; and a strain relief member having a base, sides extending from the base, and external ratcheting ribs positioned on each side, the strain relief member being configured to fit through the opening, engage the internal ratcheting ribs on the internal surfaces, and apply a compression force on the protective outer jacket of the telecommunications cable. The sides of the strain relief member are configured to fit around the protective outer jacket of the telecommunications cable. In one example, the base of the strain relief member has a form factor corresponding to the shape of the protective outer jacket of the telecommunications cable. In another example, the rear component further includes apertures, each aperture configured to receive a distal end of each side of the strain relief member. In another example, the rear component includes an arm configured to prevent a latching handle from being snagged.

In some examples, the housing includes a latching handle configured to secure the modular plug to a receptacle. In some further examples, the housing includes an array of slots along a leading edge, the wire contacts being received in the array of slots and being configured to electrically connect the twisted pairs of wires in the telecommunications cable to the contact springs of a telecommunications jack.

In one aspect, a telecommunications cable is terminated by the modular plug.

In another aspect, a method of terminating a telecommunications cable with a modular plug comprises: sliding twisted pairs of wires through channels of a wire manager; using gates on the channels to hold the twisted pairs of wires; straightening twisted pairs of wires; sliding a load bar onto the wires and attaching the load bar to the wire manager; trimming the wires to be flush with a distal end of the load bar; attaching a housing to the load bar; and crimping wire contacts housed inside the housing to contact the wires. The method may further comprise attaching a rear component to the housing. The method may also further comprise trimming the wires to have a predetermined length beyond the wire manager. In one example, the channels are axially positioned about a central axis of the wire manager.

A variety of additional inventive aspects will be set forth in the description that follows. The inventive aspects can relate to individual features and to combinations of features. It is to be understood that both the forgoing general description and the following detailed description are exemplary and explanatory only and are not restrictive of the broad inventive concepts upon which the examples disclosed herein are based.

DESCRIPTION OF THE FIGURES

The following drawing figures, which form a part of this application, are illustrative of described technology and are not meant to limit the scope of the disclosure in any manner.

DETAILED DESCRIPTION

Figure 1:
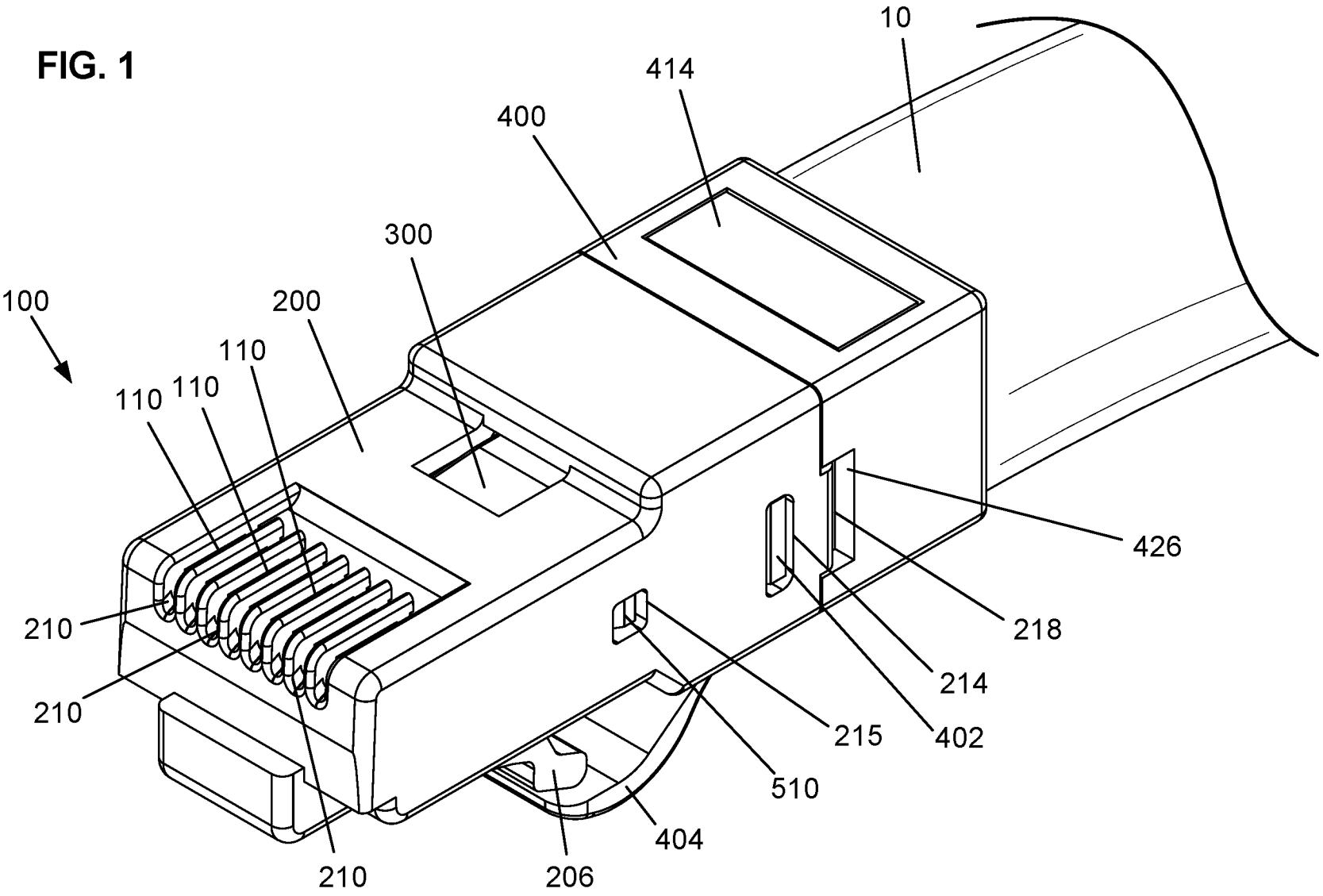
FIG. 1 is a perspective view of a telecommunications cable terminated by a modular plug.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

Figure 2:
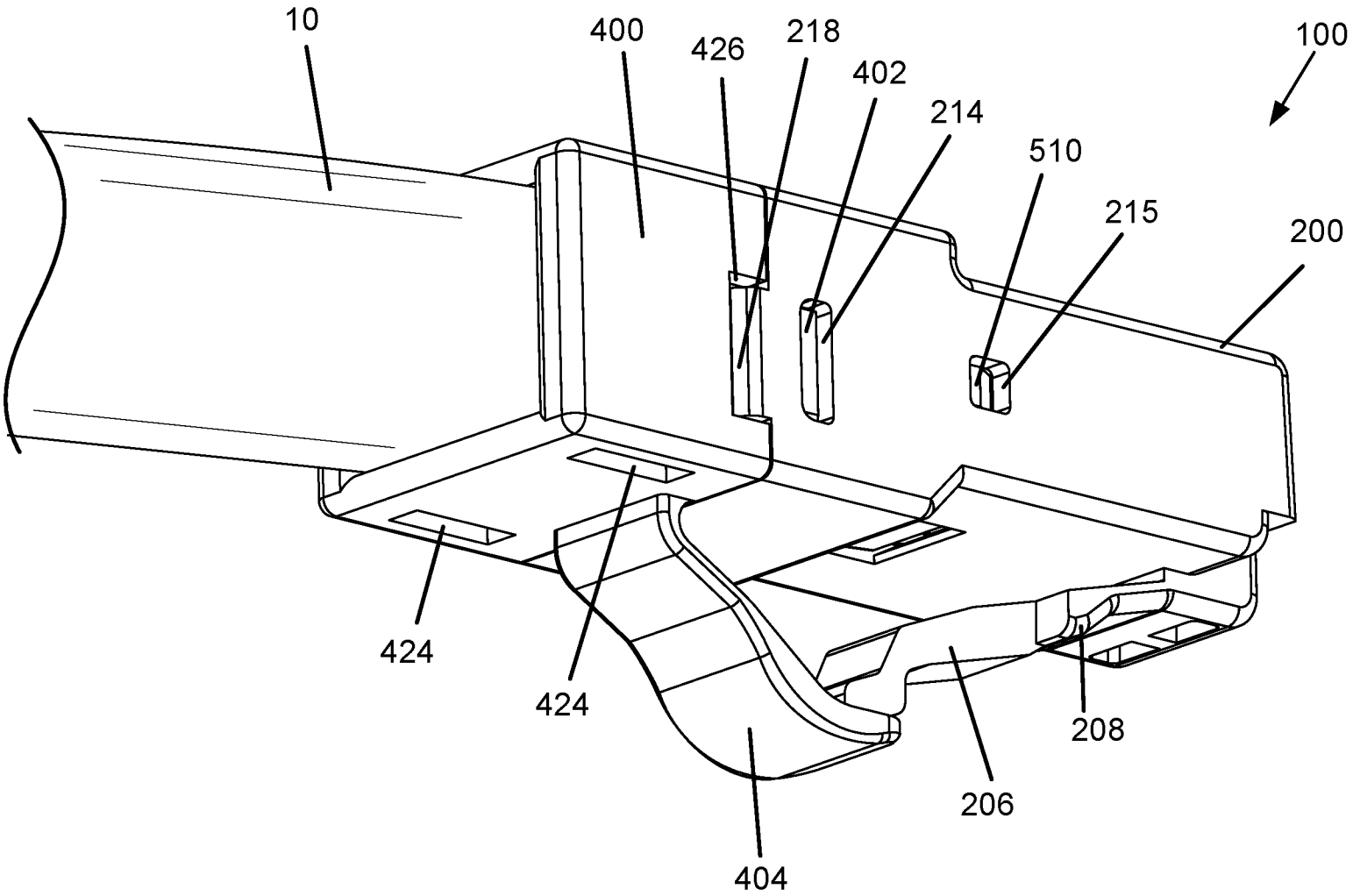
FIG. 2 is another perspective view of the telecommunications cable and modular plug.
Figure 3:
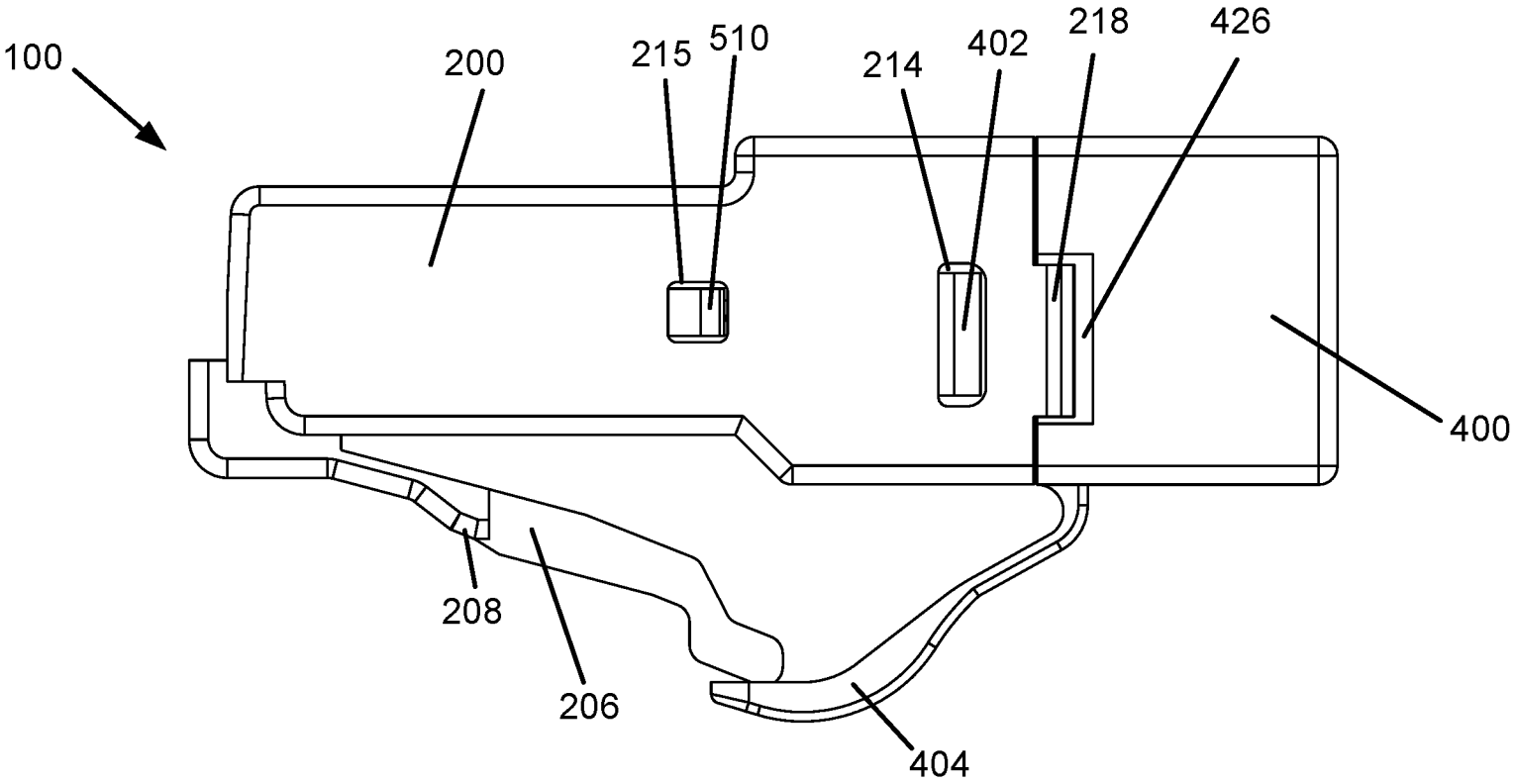
FIG. 3 is a right side view of the modular plug.
Figure 4:
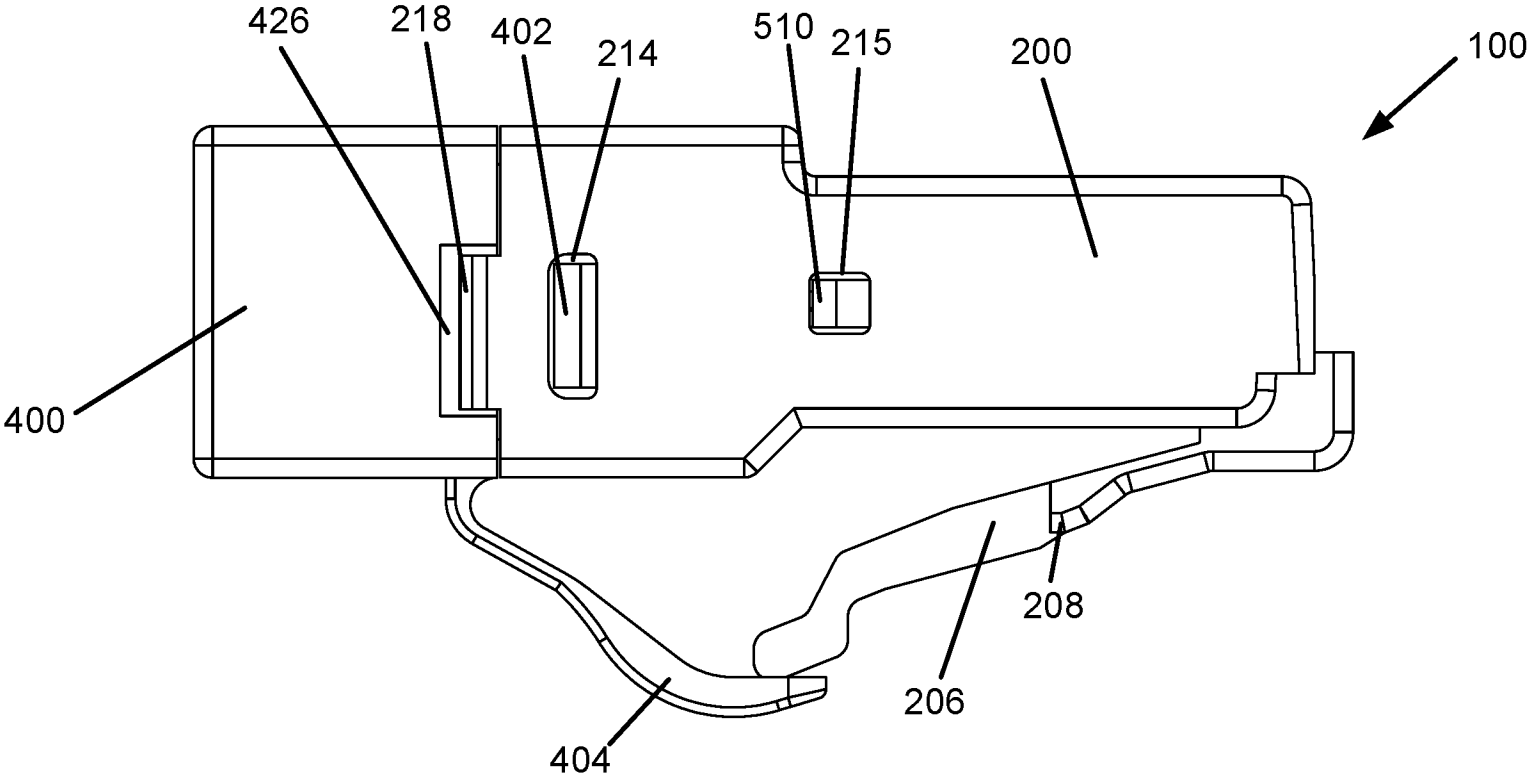
FIG. 4 is a left side view of the modular plug.
Figure 6:
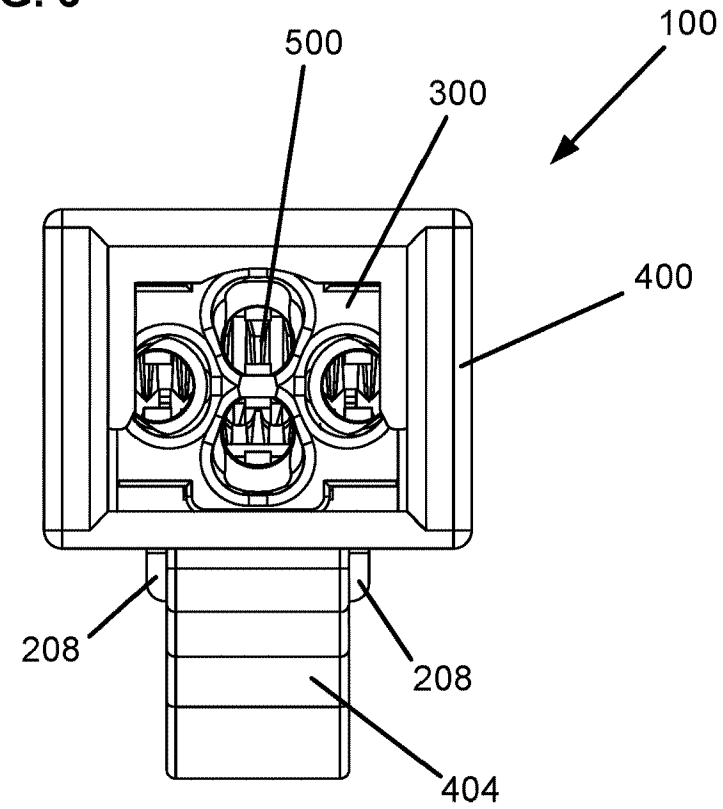
FIG. 6 is a rear view of the modular plug.
Figure 5:
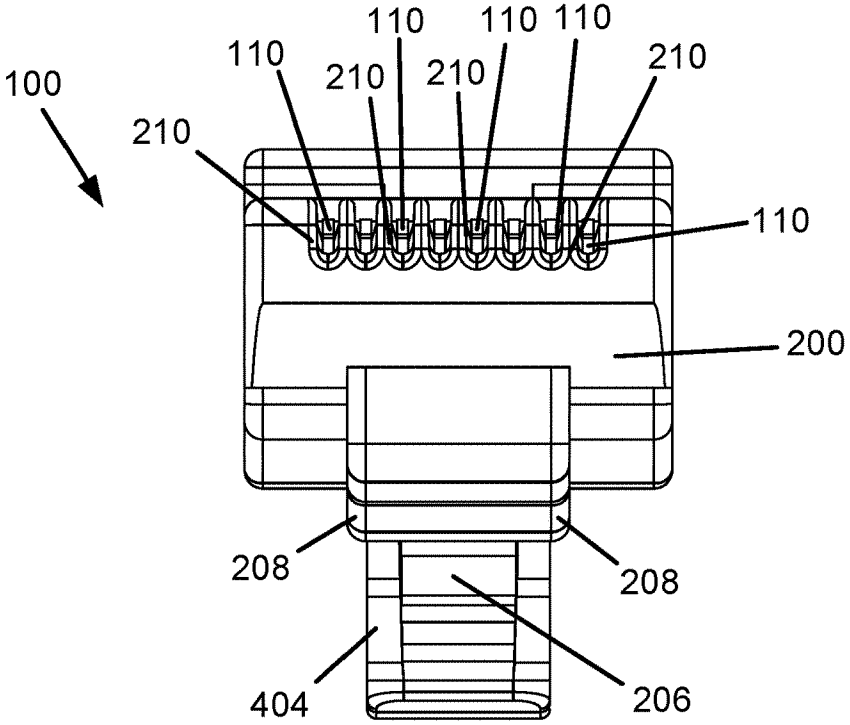
FIG. 5 is a front view of the modular plug.
Figure 7:
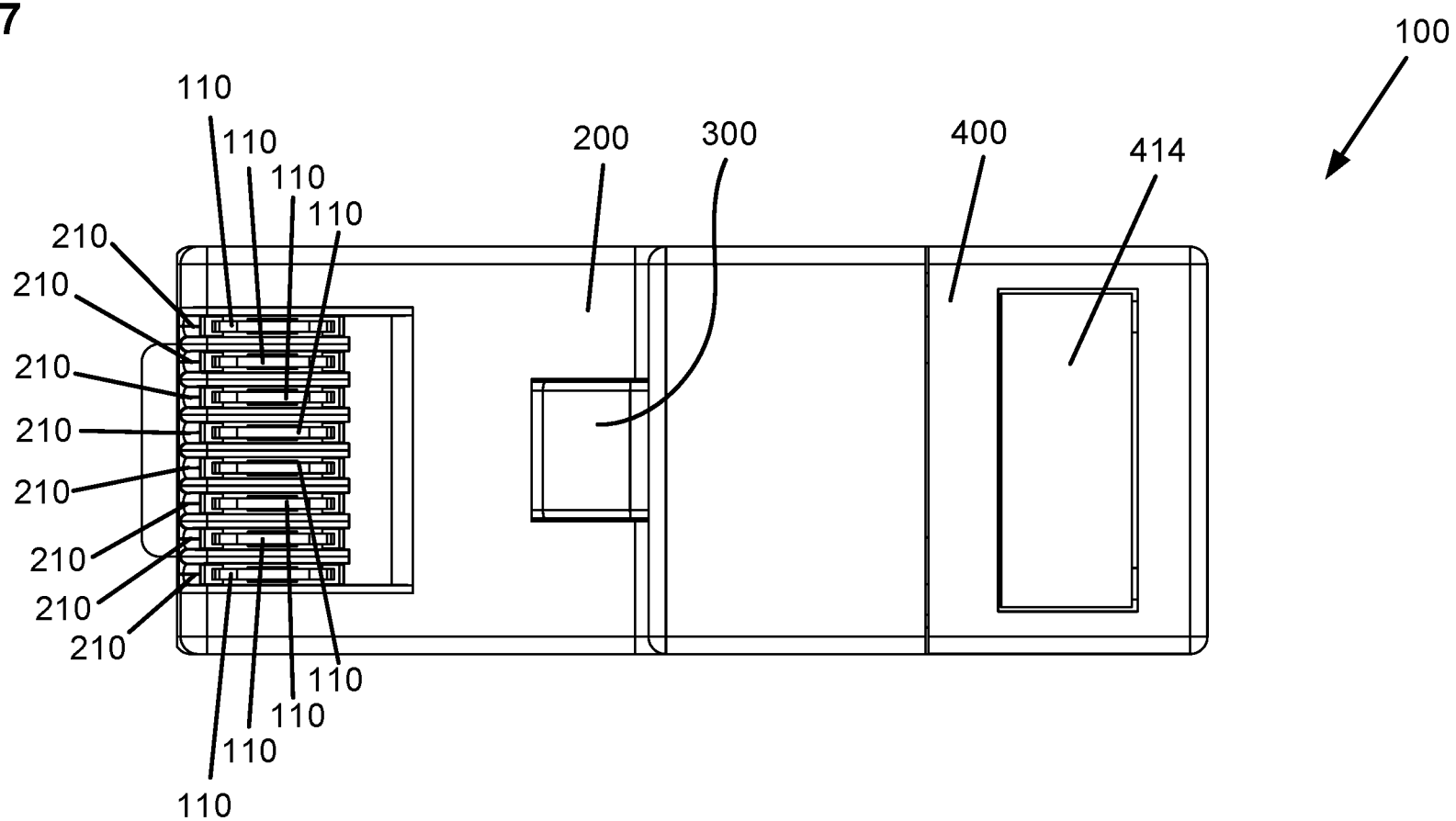
FIG. 7 is a top view of the modular plug.
Figure 8:
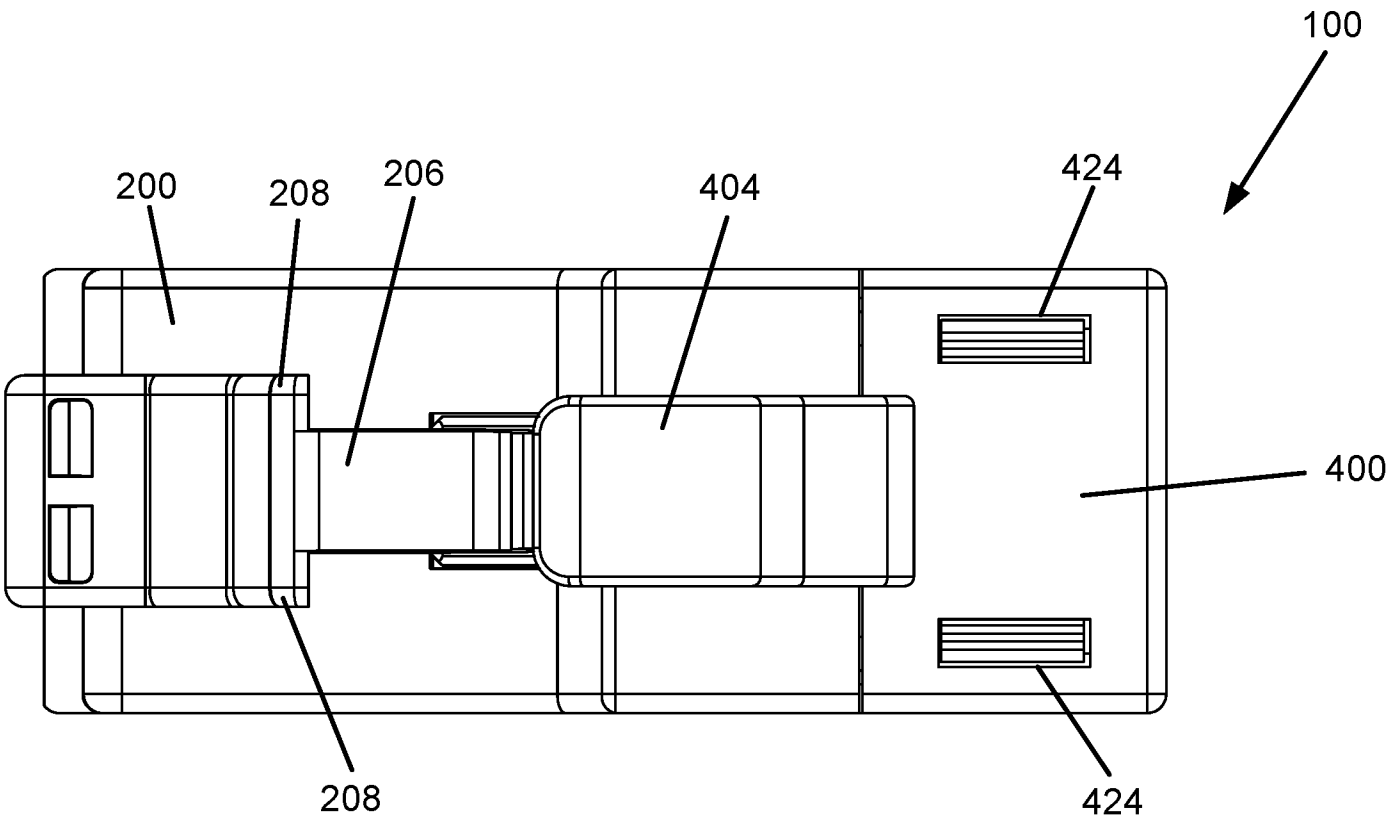
FIG. 8 is a bottom view of the modular plug.
Figure 9:
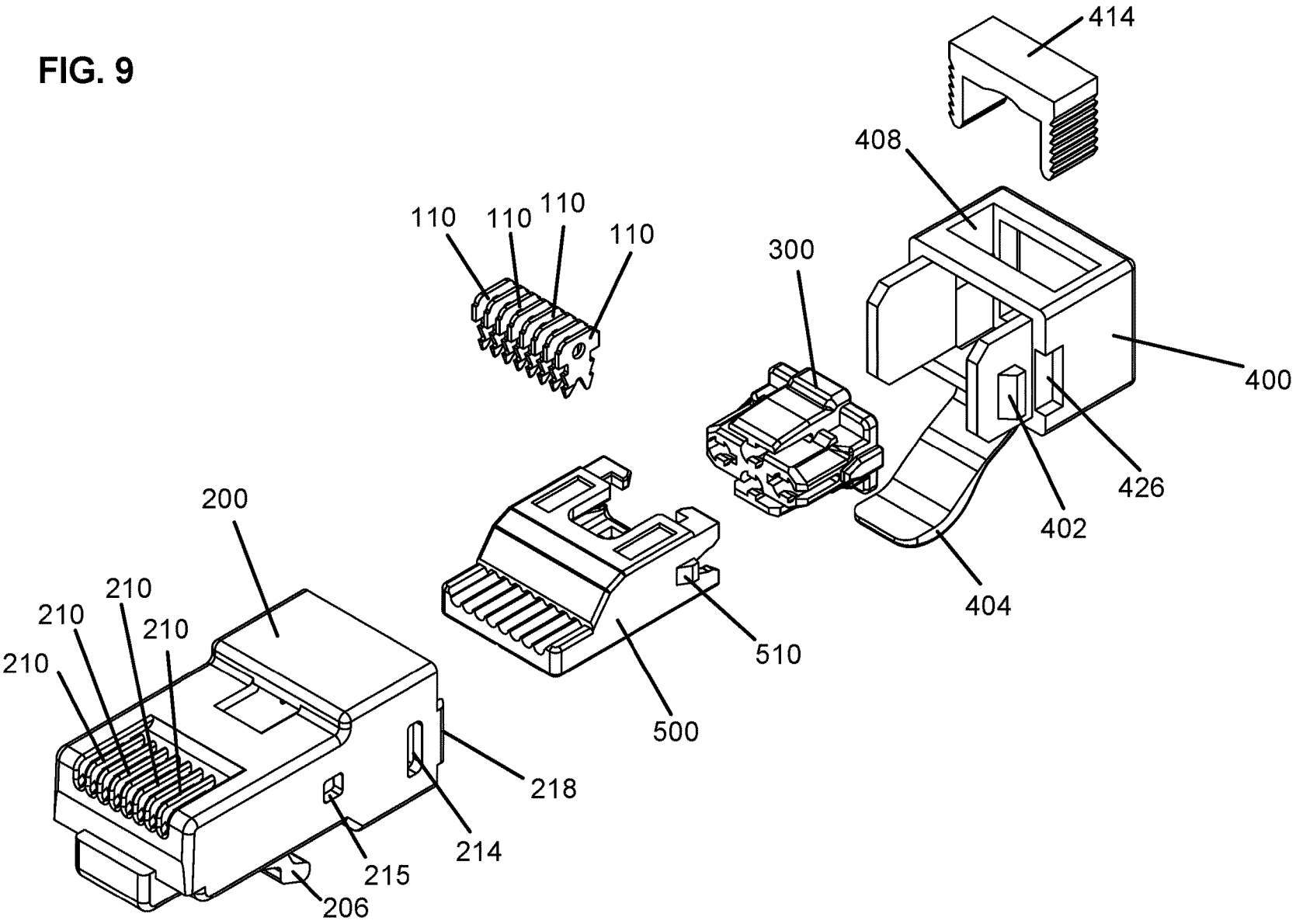
FIG. 9 is an exploded view of the modular plug.

FIGS. 1 and 2 are perspective views of a telecommunications cable 10 terminated by a modular plug 100. The telecommunications cable 10 includes twisted pairs of wires housed inside a protective outer jacket. The twisted pairs of wires are configured to transmit signals. For example, information such as video, audio, and data may be transmitted in the form of balanced signals over a pair of twisted wires. The transmitted signal is defined by the voltage difference between the wires. The telecommunications cable 10 includes four twisted pairs of wires.

As shown in FIGS. 1 and 2, the modular plug 100 is configured to terminate the telecommunications cable 10. In particular, the modular plug 100 is configured to terminate the twisted pairs of wires housed inside the jacket of the telecommunications cable 10.

FIGS. 3-9 depict right side, left side, front, rear, top, bottom, and exploded views, respectively, of the modular plug 100. As shown in FIGS. 3-9, the modular plug 100 includes a housing 200, a wire manager 300 (see FIG. 9), a rear component 400, and a load bar 500 (see FIG. 9). As will be described, the housing 200, wire manager 300, rear component 400, and load bar 500 are configured to snap-fit together to assemble the modular plug 100.

Figure 10:
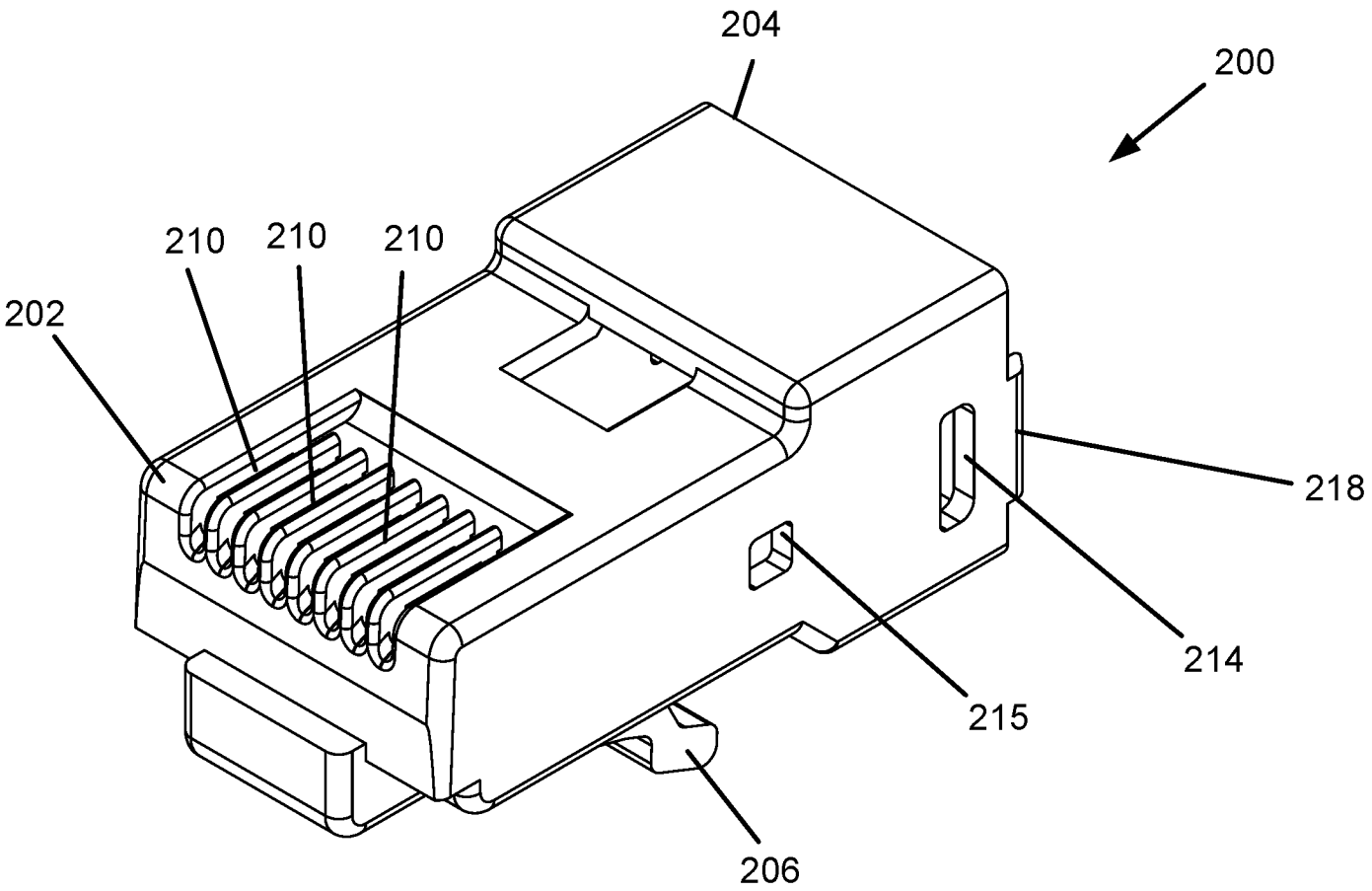
FIG. 10 is a front perspective view of a housing.
Figure 11:
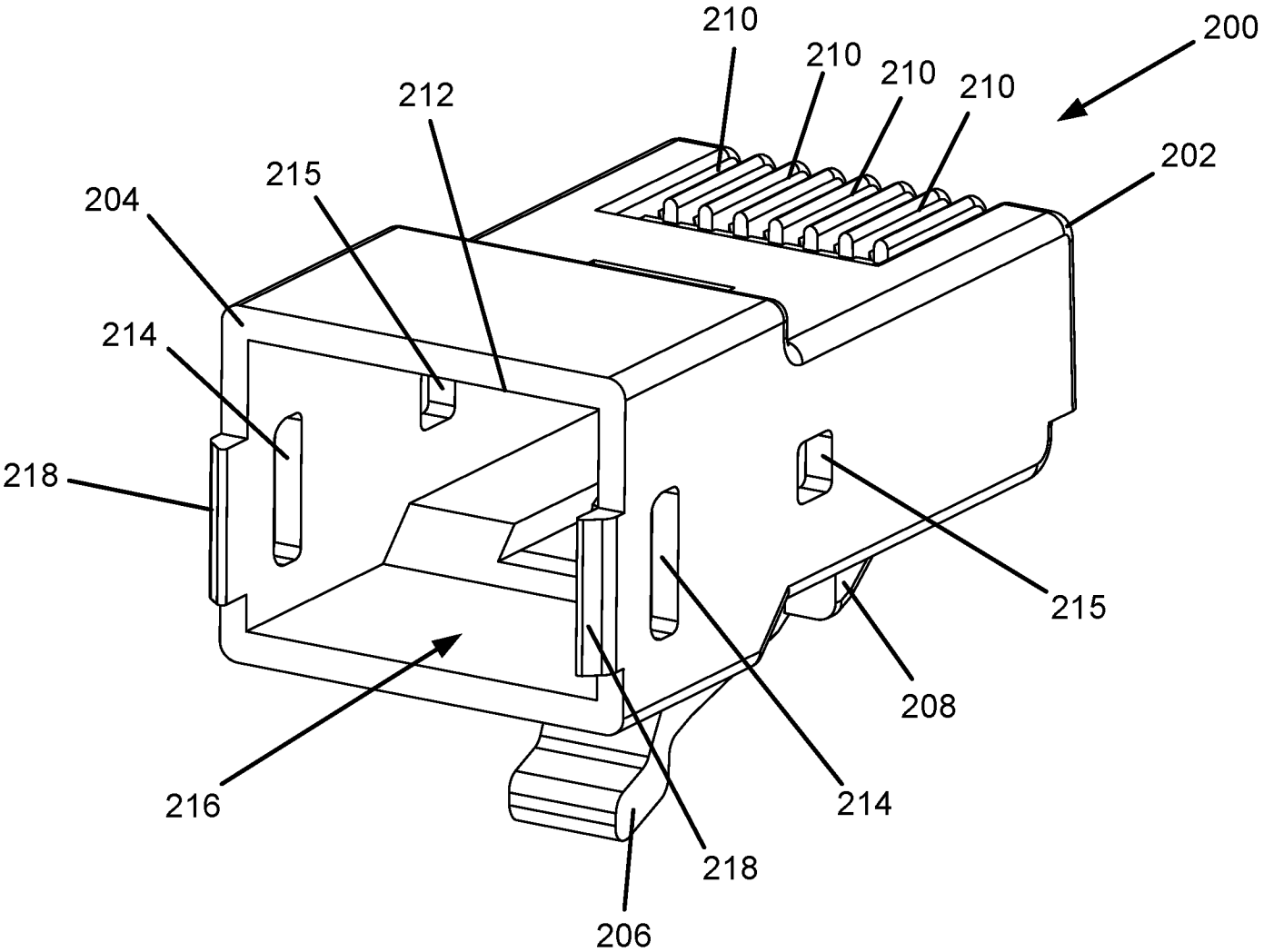
FIG. 11 is a rear perspective view of the housing.

FIGS. 10 and 11 are front and rear perspective views of the housing 200. As shown in FIGS. 10 and 11, the housing 200 extends from a first end 202 to a second end 204, and defines an internal cavity 216. The internal cavity 216 is configured to receive the wire manager 300, the load bar 500, and the twisted pairs of wires of the telecommunications cable 10.

As shown in FIGS. 10 and 11, the housing 200 further includes an array of slots 210 along a leading edge of the first end 202. As shown in FIGS. 1 and 2, the modular plug 100 includes a plurality of wire contacts 110. Each wire contact 110 is received by a slot 210 in the housing 200 and is configured to electrically connect the twisted pairs of wires in the telecommunications cable 10 to the contact springs of a telecommunications jack. A load bar 500 (see FIG. 9) aligns the wires with the wire contacts 110. In the example shown, eight wire contacts 110 and eight slots 210 are illustrated. Accordingly, the modular plug 100 may correspond to an RJ-45 jack. Other configurations are possible.

Referring now to FIGS. 10 and 11, the housing 200 includes a latching handle 206 having shoulders 208. The latching handle 206 and shoulders 208 are configured to secure the modular plug 100 to a receptacle such as a telecommunications jack.

As shown in FIGS. 10 and 11, the housing 200 at the second end 204 includes an aperture 212 that receives the wire manager 300 and load bar 500. The housing 200 has trailing edges 218 that are received by slots 426 on the rear component 400. Also, the housing 200 includes slots 214 that receive tabs 402 on the rear component 400 (see FIGS. 12 and 13). Accordingly, the housing 200 snap-fits onto the rear component 400.

Figure 12:
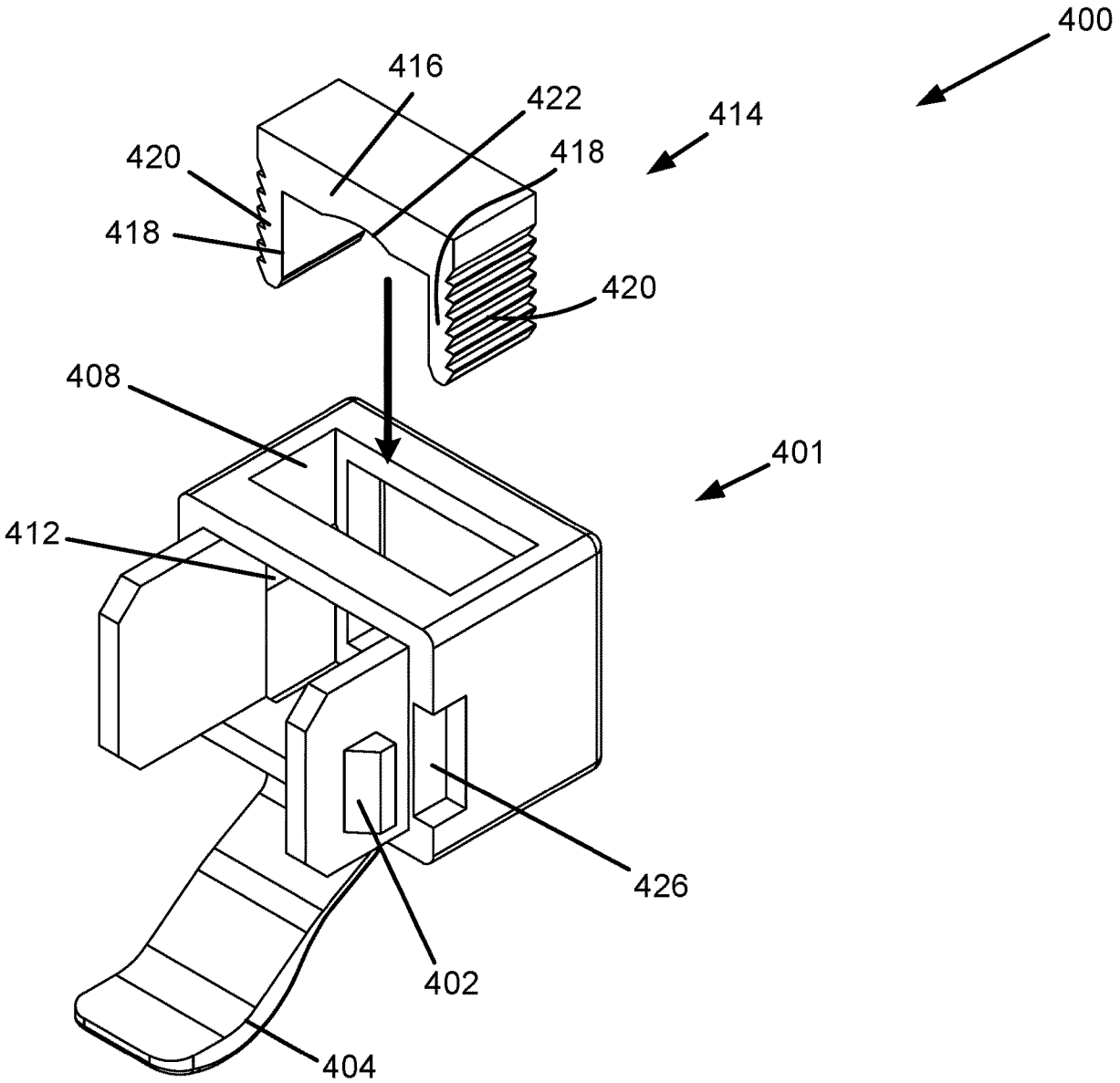
FIG. 12 is a front perspective view of a rear component.
Figure 13:
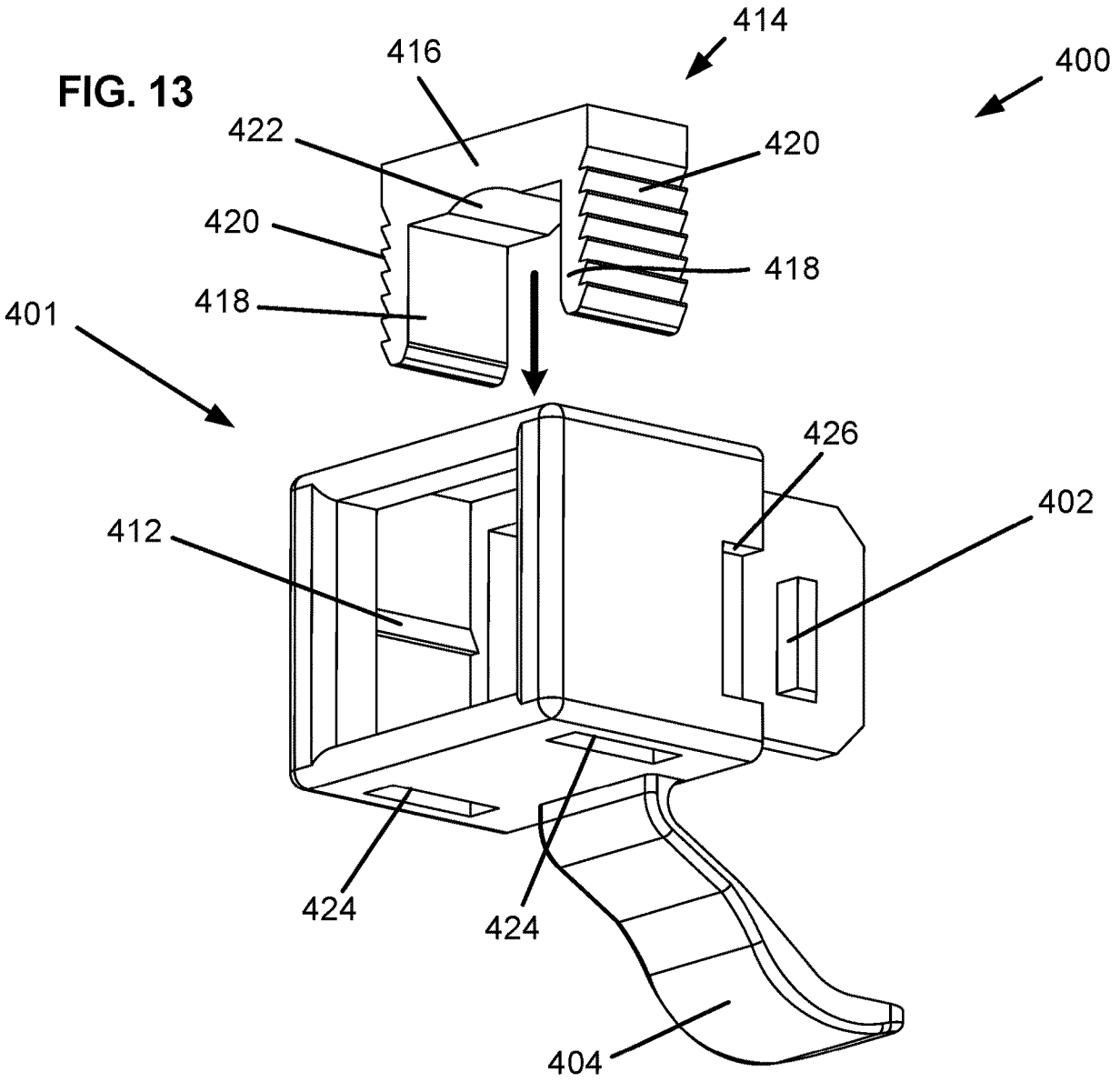
FIG. 13 is a rear perspective view of the rear component.
Figure 14:
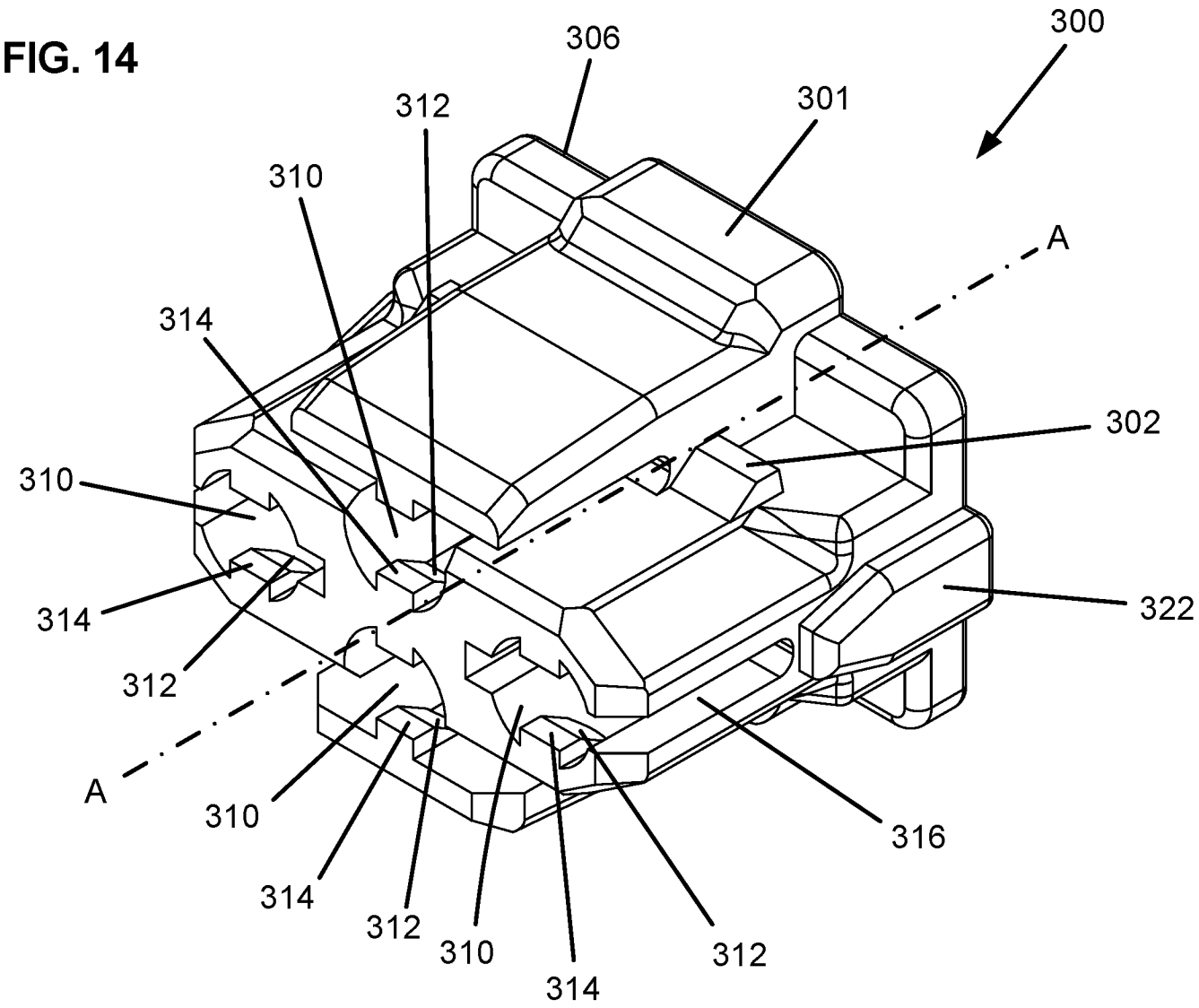
FIG. 14 is a perspective view of a wire manager.
Figure 16:
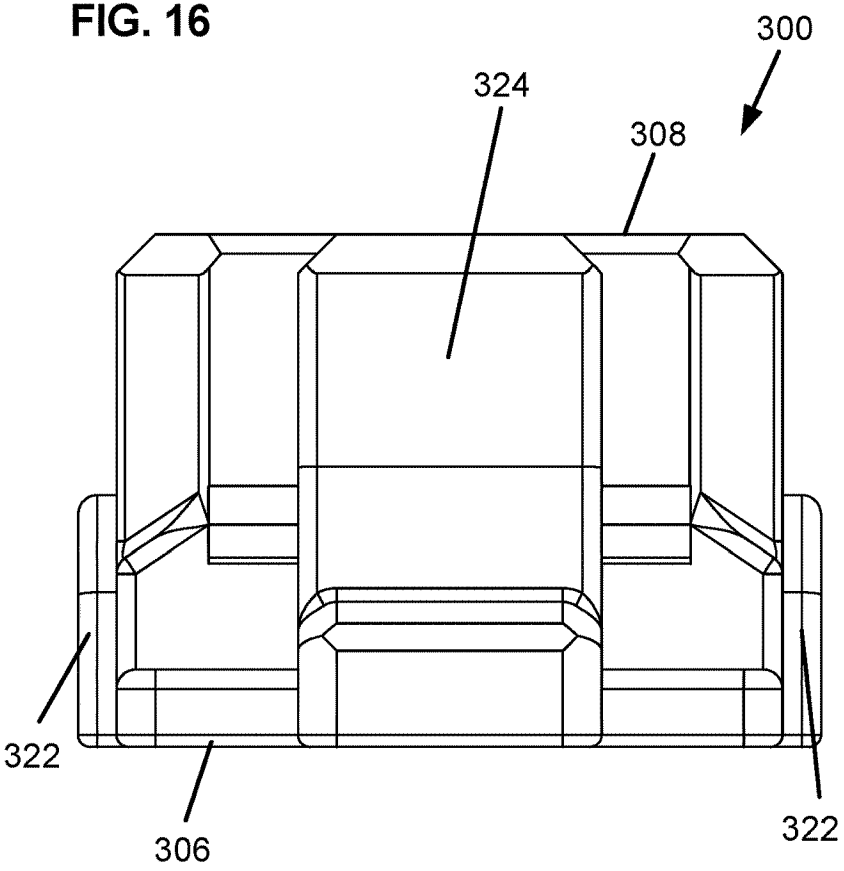
FIG. 16 is a bottom view of the wire manager.
Figure 15:
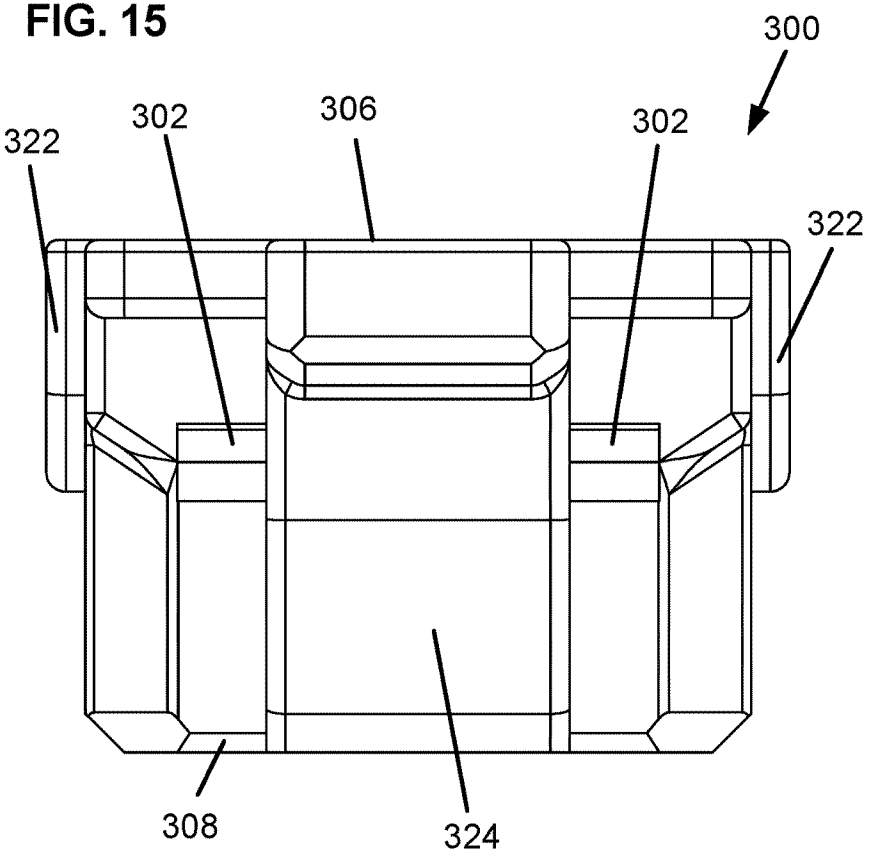
FIG. 15 is a top view of the wire manager.
Figure 18:
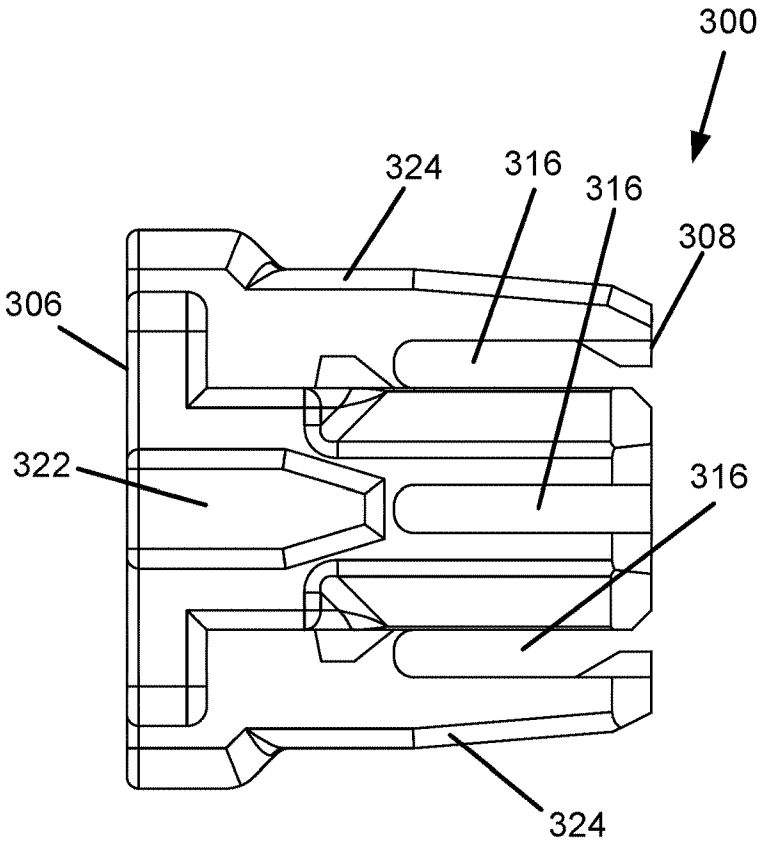
FIG. 18 is a left side view of the wire manager.
Figure 17:
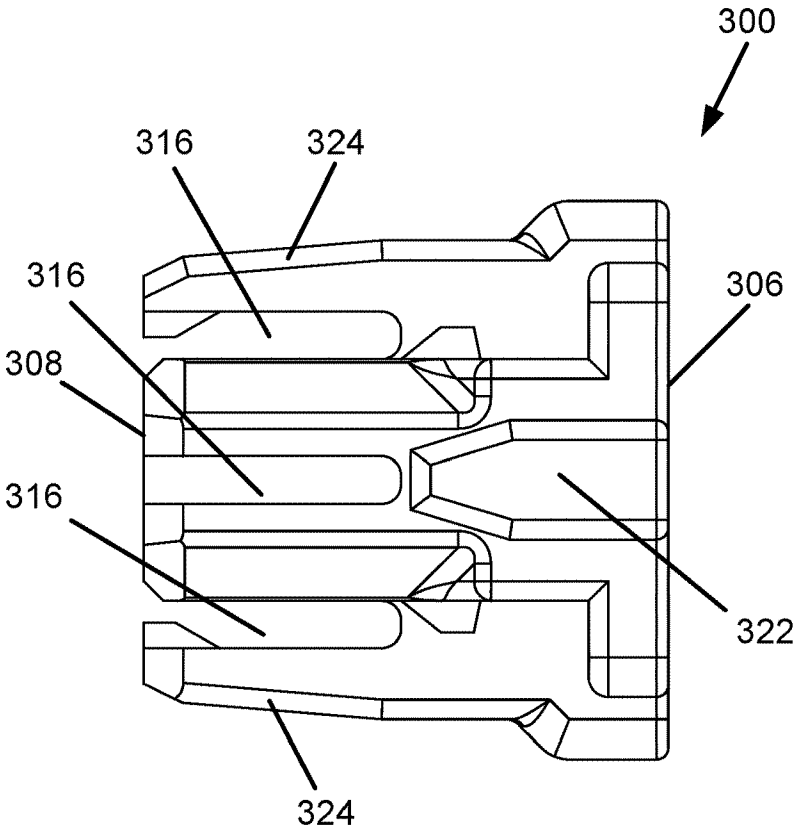
FIG. 17 is a right side view of the wire manager.

FIGS. 12 and 13 are front perspective and rear perspective views, respectively, of the rear component 400. The rear component 400 includes a body 401 that receives the terminal end of the telecommunications cable 10. The tabs 402 are positioned on the sides of the body 401. As described above, the tabs 402 are received by the slots 214 of the housing 200 such that the housing 200 snap-fits onto the rear component 400. Also, the rear component 400 has slots 426 that receive a trailing edge 218 of the housing 200.

The body 401 includes an arm 404 that can prevent the latching handle 206 of the housing 200 from snagging or being snagged. The arm 404 may also actuate the latching handle 206 by transmitting pressure asserted onto the arm 404 to the latching handle 206 to insert or remove the modular plug 100 from a telecommunications jack. Accordingly, the difficulty of actuating the latching handle 206 of the housing 200 due to the relatively small size of the modular plug 100 is reduced or eliminated by the arm 404 of the rear component 400.

The rear component 400 further includes a strain relief member 414 that has a base 416, sides 418 extending from the base 416, and external ratcheting ribs 420 positioned on each side 418. The strain relief member 414 fits through an opening 408 in the body 401 of the rear component, and the external ratcheting ribs 420 engage and lock onto the internal ratcheting ribs 412 of the body 401. In an alternative embodiment, the strain relief member 414 and the opening 408 may be included in the housing 200.

When the strain relief member 414 is pushed downward through the opening 408, the strain relief member 414 applies a compression force on the protective outer jacket of the telecommunications cable 10. Advantageously, the strain relief member 414 can securely lock the rear component 400 onto the terminal end of the telecommunications cable 10.

In some examples, the base 416 of the strain relief member 414 includes a form factor 422. The form factor 422 can have a shape that corresponds to the exterior shape of the telecommunications cable 10. For example, the form factor 422 can have a semi-circular shape to match the exterior shape of a rounded telecommunications cable 10. Other configurations, including other shapes and sizes for the form factor 422, are possible.

The rear component 400 further includes apertures 424. Each aperture 424 can receive a distal end of each side 418 of the strain relief member 414. When the strain relief member 414 is inserted through the opening 408, the sides 418 of the strain relief member 414 fit around the protective outer jacket of the telecommunications cable 10, and the base 416 compresses the protective outer jacket of the telecommunications cable 10 onto at least a portion of the rear component 400. Depending on the diameter of the telecommunications cable 10, the distal ends of the sides 418 can be inserted through the apertures 424 of the rear component 400.

FIGS. 14-20 are perspective, top, bottom, right side, left side, front, and rear views, respectively, of the wire manager 300. As shown in FIGS. 14-20, the wire manager 300 is sized and shaped to fit within the internal cavity 216 of the housing 200. During assembly of the modular plug 100 onto the telecommunications cable 10, a portion of the outer protective jacket is stripped and the exposed twisted pairs of wires extend through the wire manager 300 before reaching the internal cavity 216 of the housing 200 and the array of wire contacts 110.

Figure 20:
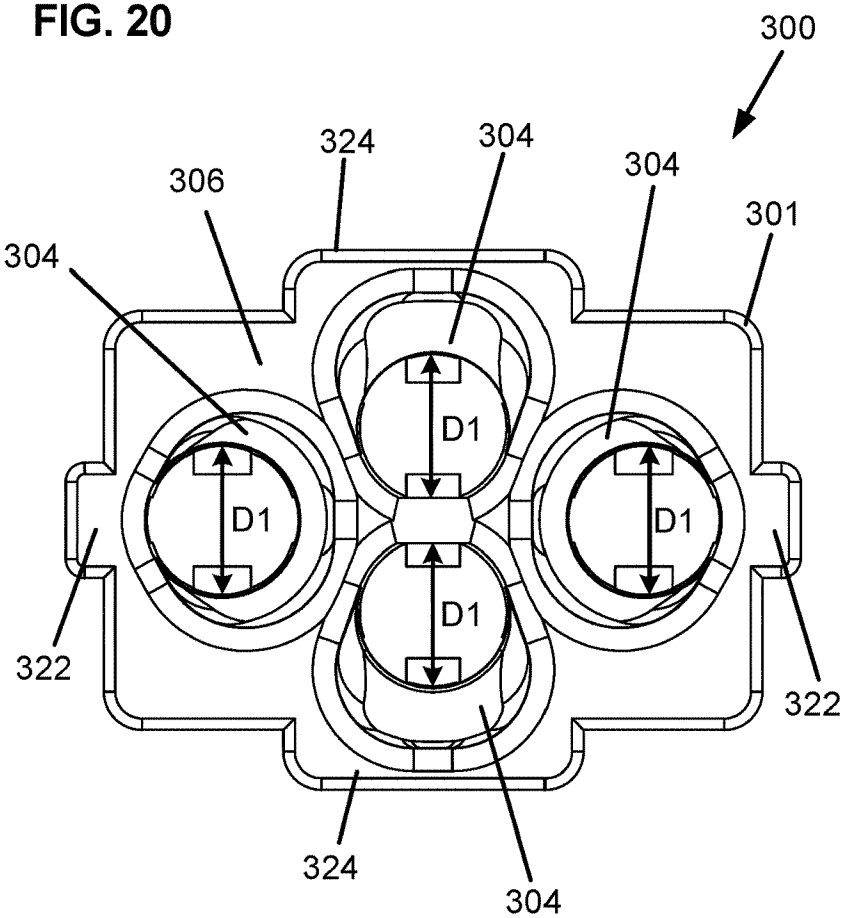
FIG. 20 is a rear view of the wire manager.
Figure 19:
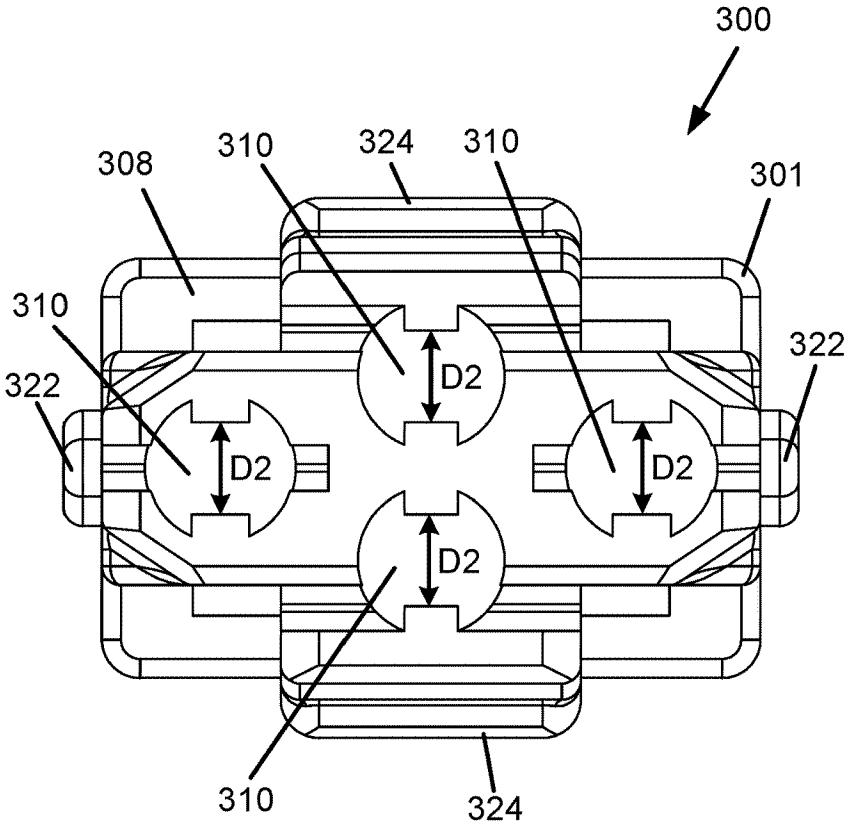
FIG. 19 is a front view of the wire manager.
Figure 21:
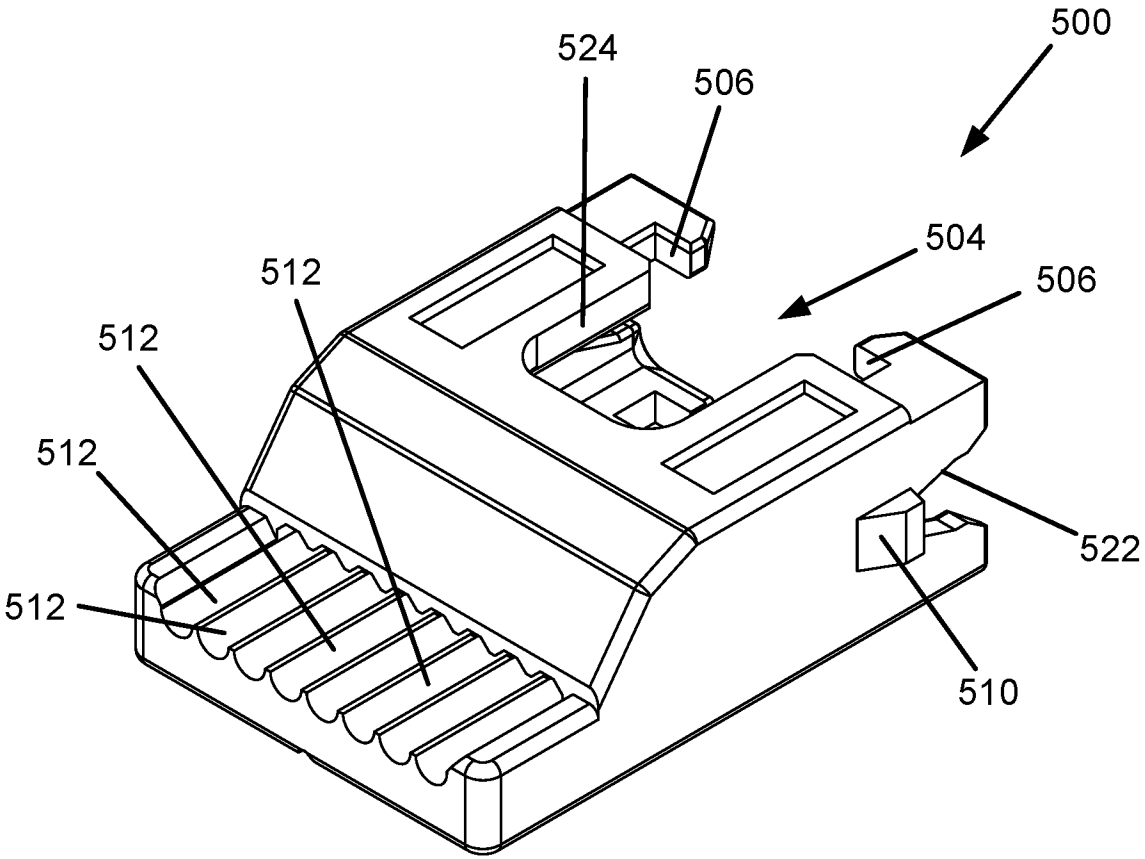
FIG. 21 is a perspective view of a load bar.

The wire manager 300 includes a body 301 having a plurality of channels 304 axially positioned about a central axis A-A. FIG. 20 is a rear view of the wire manager 300, and shows that the wire manager 300 includes four channels 304. Each channel 304 may include a variable width such that the width of each channel 304 at a first end 306 of the body 301 is larger than a width at a second end 308 of the body 301.

As described above, the telecommunications cable 10 includes four twisted pairs of wires. Accordingly, when the telecommunications cable 10 is terminated by the modular plug 100, each twisted pair of wires is received by a channel 304. In alternative examples, the wire manager 300 can have a greater or lesser number of channels 304 as may be needed or desired for a particular application. For example, the wire manager 300 can define two, three, five, seven, or eight channels. Other configurations are possible.

Each channel 304 receives a twisted pair of wires from the telecommunications cable 10 at the first end 306, and each twisted pair of wires exits each channel 304 at the second end 308. Each channel 304 includes a gate 310 at the second end 308.

Each gate 310 defines a smallest dimension of each channel 304 to be substantially similar to the diameter of a single wire from each twisted pair of wires. In some examples, each gate 310 has a smallest dimension that is less than twice the diameter of a single wire. In some further examples, each gate 310 has a smallest dimension that is equal to or less than the diameter of a single wire from each twisted pair of wires.

Each gate 310 reduces the width of each channel 304 at the second end 308. For example, each channel 304 has a first width D1 at the second end 308 (see FIG. 20), each gate 310 defines a second width D2 at the second end 308 (See FIG. 19), and the second width D2 of each gate 310 is smaller than the first width D1 of each channel 304. In some examples, each gate 310 reduces the width of each channel 304 to be substantially less than twice the diameter of a single wire. In some further examples, each gate 310 is sized and shaped to engage a twisted pair of wires on both sides of the twisted pair.

Advantageously, the gates 310 maintain the twist and spacing between the twisted pairs of wires before the wires reach the load bar 500 and the wire contacts 110. By maintaining the twist and spacing, the wire manager 300 can reduce crosstalk between the wires inside the modular plug 100, and thus improve the performance of the modular plug 100.

Each gate 310 includes opposing sloped surfaces 312 that are angled in converging directions with respect to the central axis A-A. The opposing sloped surfaces 312 extend from the rear to the front of the wire manager 300. Each gate 310 can also include opposing parallel surfaces 314 that are substantially parallel to the central axis A-A. Accordingly, the second width D2 of each gate 310 is smaller than the first width D1 of each channel 304. In some examples, the smaller width D2 of the gates 310 can hold the twisted pair of wires.

Each channel 304 includes at least one slit 316 that permits each channel 304 to flex around a twisted pair of wires. Accordingly, in some examples, each gate 310 can hold a twisted pair of wires before the wires reach the load bar 500. In some examples, each gate 310 can hold a twisted pair of wires in a stacked horizontal arrangement.

In the examples shown in FIGS. 14-20, each channel 304 has a circular cross-section. Other configurations are possible such as other cross-sectional shapes and sizes.

The body 301 of the wire manager 300 further includes tabs 302 that latch onto corresponding notches 506 on the load bar 500. Accordingly, the wire manager 300 snap-fits onto the load bar 500. Additionally, a first set of form factors 322 extend from each side of the body 301 and are received by a first set of corresponding grooves 522 on the load bar 500. Also, a second set of form factors 324 extend from the top and bottom surfaces of the body 301 and are received by second corresponding grooves 524 on the load bar 500. In this manner, the wire manager 300 is received by the load bar 500 such that the channels 304 and corresponding gates 310 of the wire manager 300 are positioned inside an internal cavity 504 of the load bar 500.

FIGS. 21-26 are perspective, top, right side, left side, front, and rear views, respectively, of the load bar 500. The load bar 500 includes a body 502 that fits within the internal cavity 216 of the housing 200. As described above, the body 502 includes notches 506 that can receive the tabs 302 of the wire manager 300. Accordingly, the load bar 500 snap-fits onto the wire manager 300. Additionally, the body 502 includes tabs 510 that are received by slots 215 of the housing 200. Accordingly, the load bar 500 also snap-fits onto the housing 200.

The body 502 defines the internal cavity 504 that receives the wire manager 300. As described above, the body 502 includes the first set of corresponding grooves 522 that receive the first set of form factors 322 on the body 301 of the wire manager 300. Additionally, the body 502 includes the second corresponding grooves 524 that receive the second set of form factors 324 on the body 301 of the wire manager 300. Accordingly, the wire manager 300 is received by the load bar 500 such that the channels 304 and corresponding gates 310 of the wire manager 300 are positioned inside the internal cavity 504 defined by the body 502 of the load bar 500.

Figure 26:
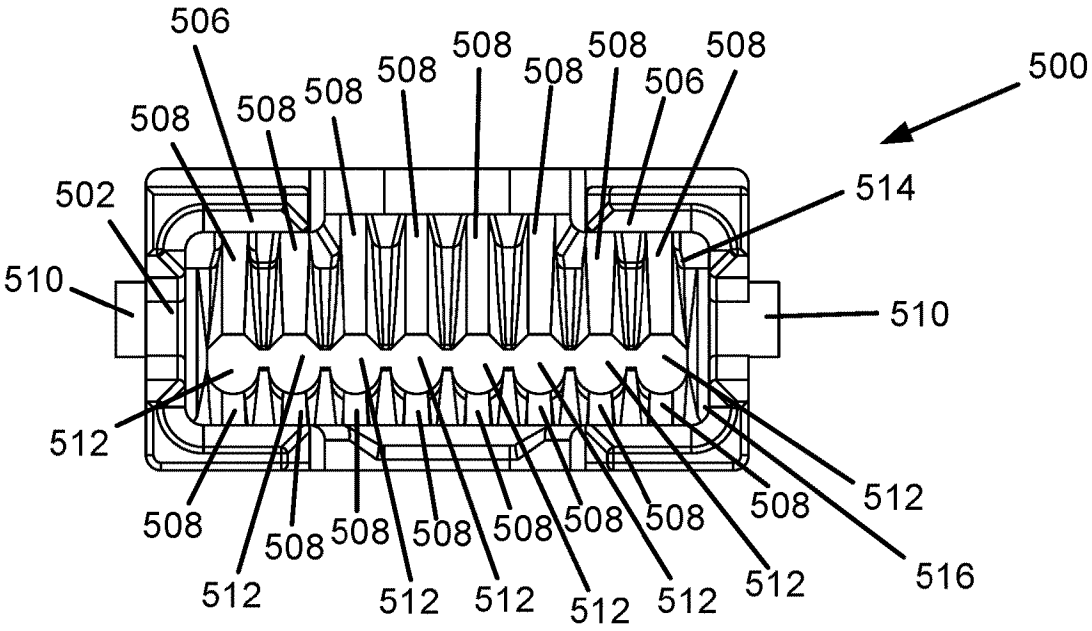
FIG. 26 is a rear view of the load bar.

As shown in FIG. 26, the internal cavity 504 of the load bar 500 includes a series of internal grooves 508 that funnel into an array of external grooves 512. The internal grooves 508 are positioned on a top surface 514 and a bottom surface 516 of the internal cavity 504, and the top surface 514 and bottom surface 516 converge into the array of external grooves 512.

Each groove in the array of external grooves 512 is sized and shaped to receive a single wire from the twisted pairs of wires in the telecommunications cable 10. As described above, each wire from the twisted pairs of wires is guided by the gates 310 of the wire manager 300 into the load bar 500, and the internal grooves 508 positioned on the top surface 514 and the bottom surface 516 of the internal cavity 504 funnel the wires into the array of external grooves 512. In the example shown, the external grooves 512 are parallel and are arranged in the same vertical plane. In other examples, the external grooves 512 are vertically offset where, for example, a first row of external grooves is positioned in a first vertical plane and a second row of external grooves is positioned in a second vertical plane, and where the first vertical plane is different from the second vertical plane. Other configurations are possible.

When the modular plug 100 is assembled, the array of external grooves 512 is configured to position each wire from the twisted pairs of wires such that each wire is aligned with a wire contact 110. In the example shown, each groove in the array of external grooves 512 is exposed (e.g., uncovered) at the front portion of the load bar 500.

A crimping tool can be used to crimp the wire contacts 110 into each wire positioned by the array of external grooves 512. Accordingly, the modular plug 100 can field terminate the telecommunications cable 10 such that each wire contact 110 electrically connects the twisted pairs of wires inside the cable to the contact springs of a telecommunications jack.

Figure 22:
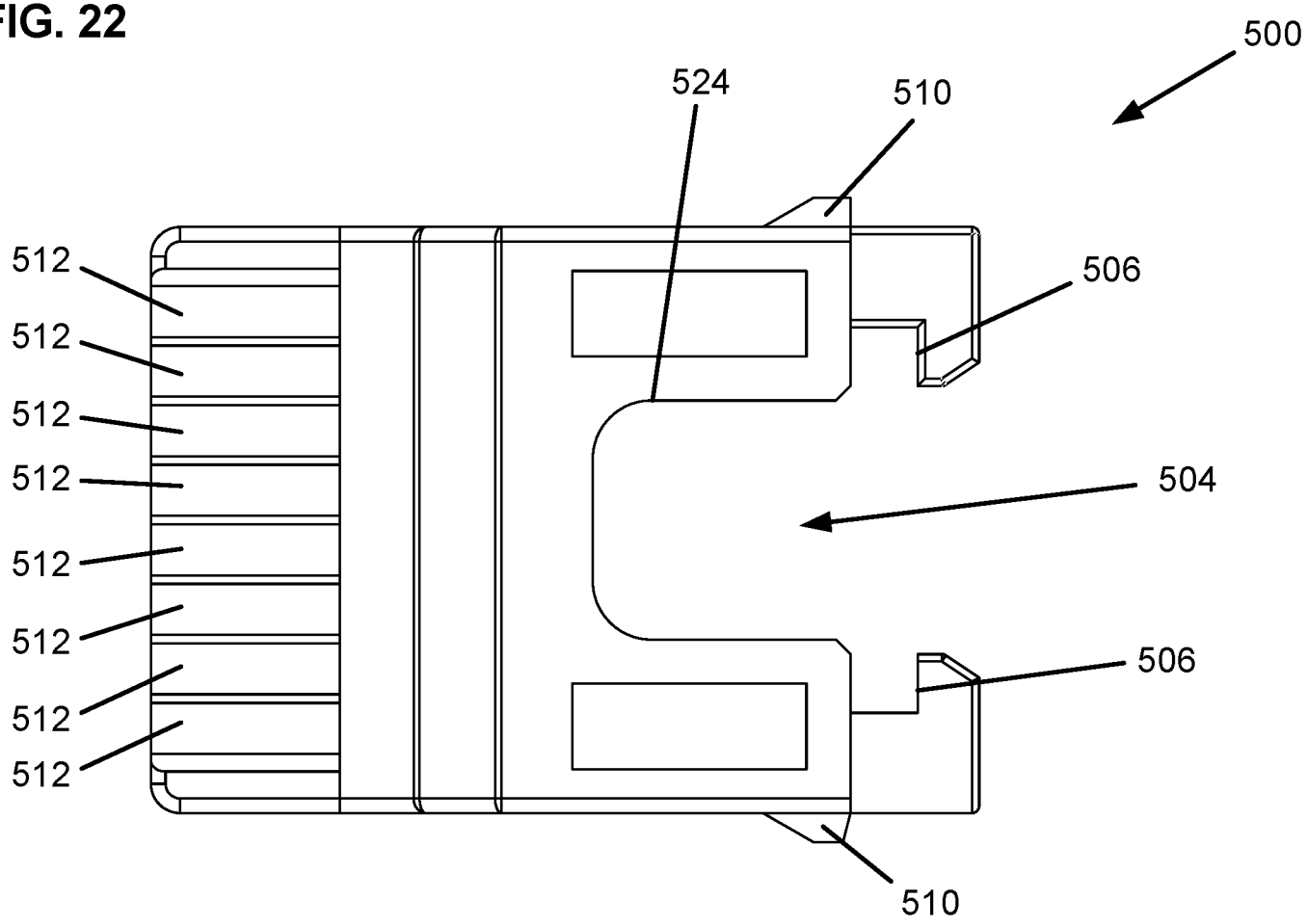
FIG. 22 is a top view of the load bar.
Figure 23:
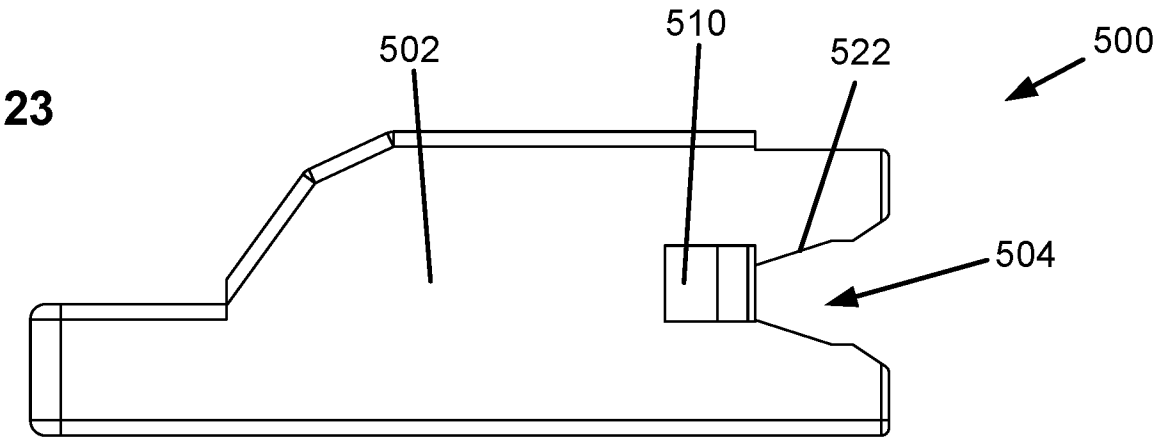
FIG. 23 is a right side view of the load bar.
Figure 24:
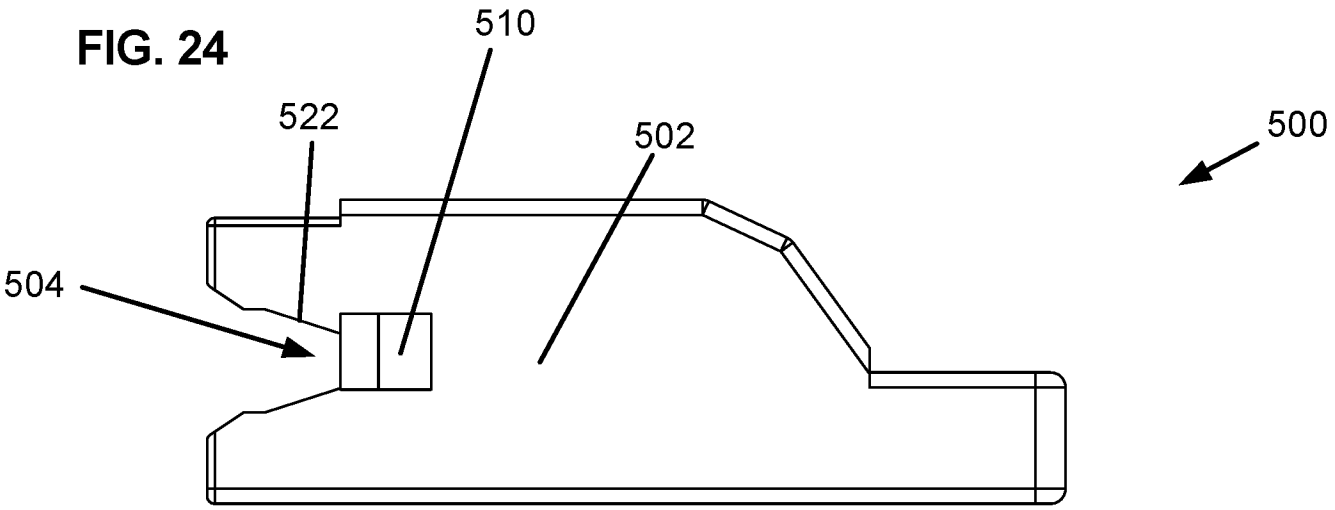
FIG. 24 is a left side view of the load bar.
Figure 25:
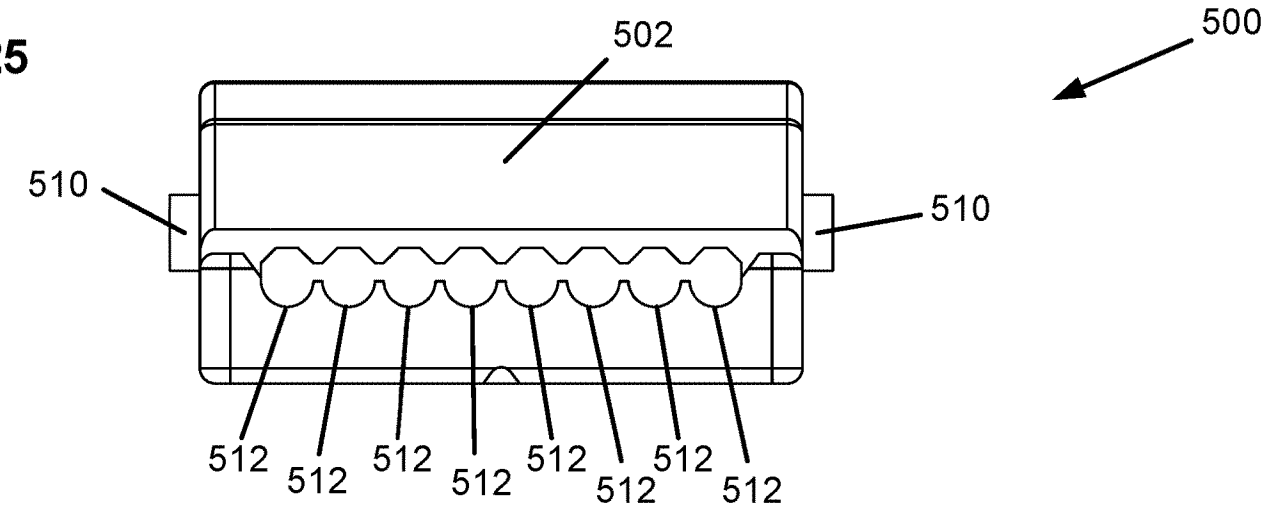
FIG. 25 is a front view of the load bar.
Figure 27:
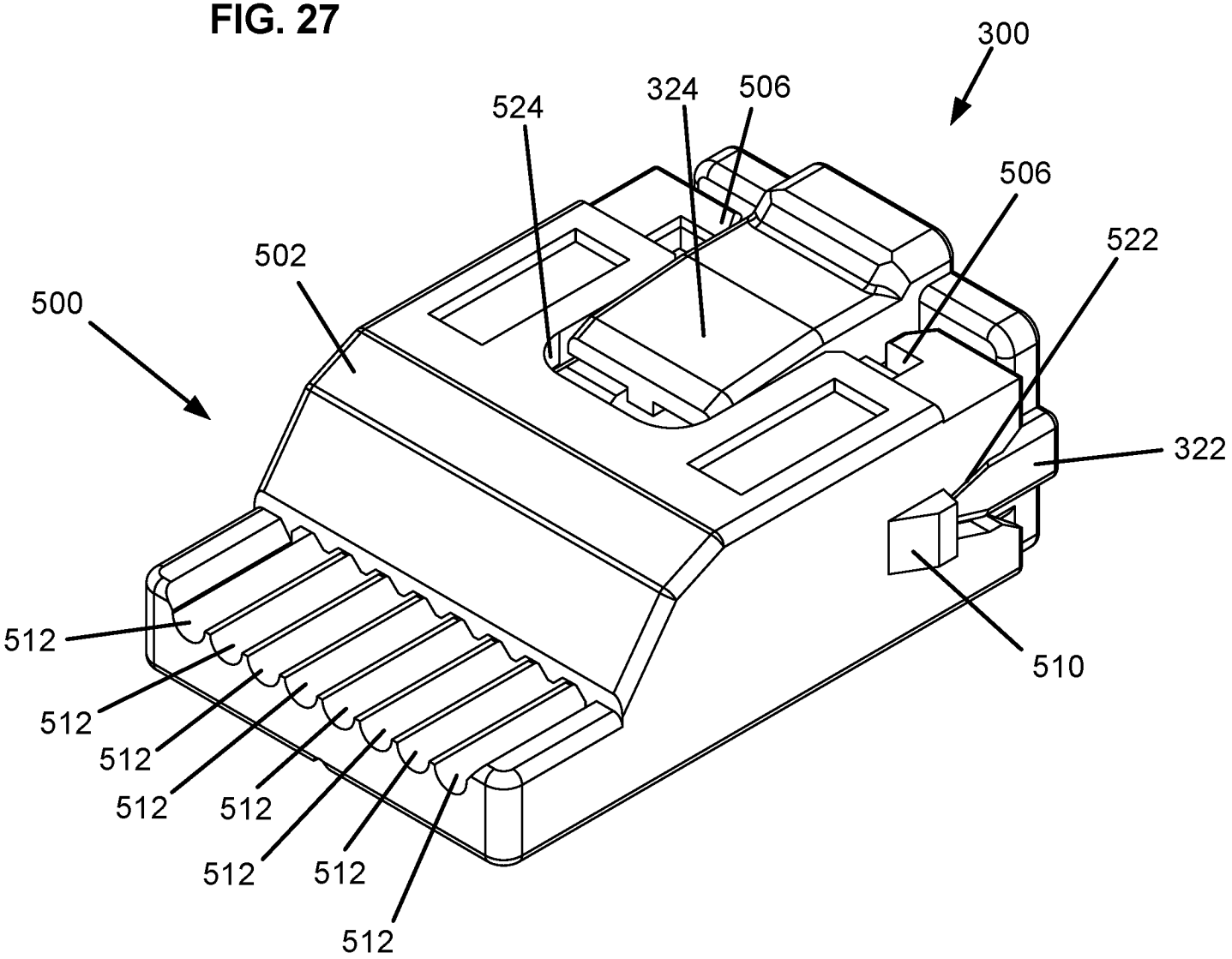
FIG. 27 is a perspective view of the load bar attached to the wire manager.

FIG. 27 is a perspective view of the load bar 500 attached to the wire manager 300. As shown in FIG. 22, the notches 506 of the load bar 500 are latched onto the tabs 302 of the wire manager 300 such that the load bar 500 snap-fits onto the wire manager 300.

Figure 28:
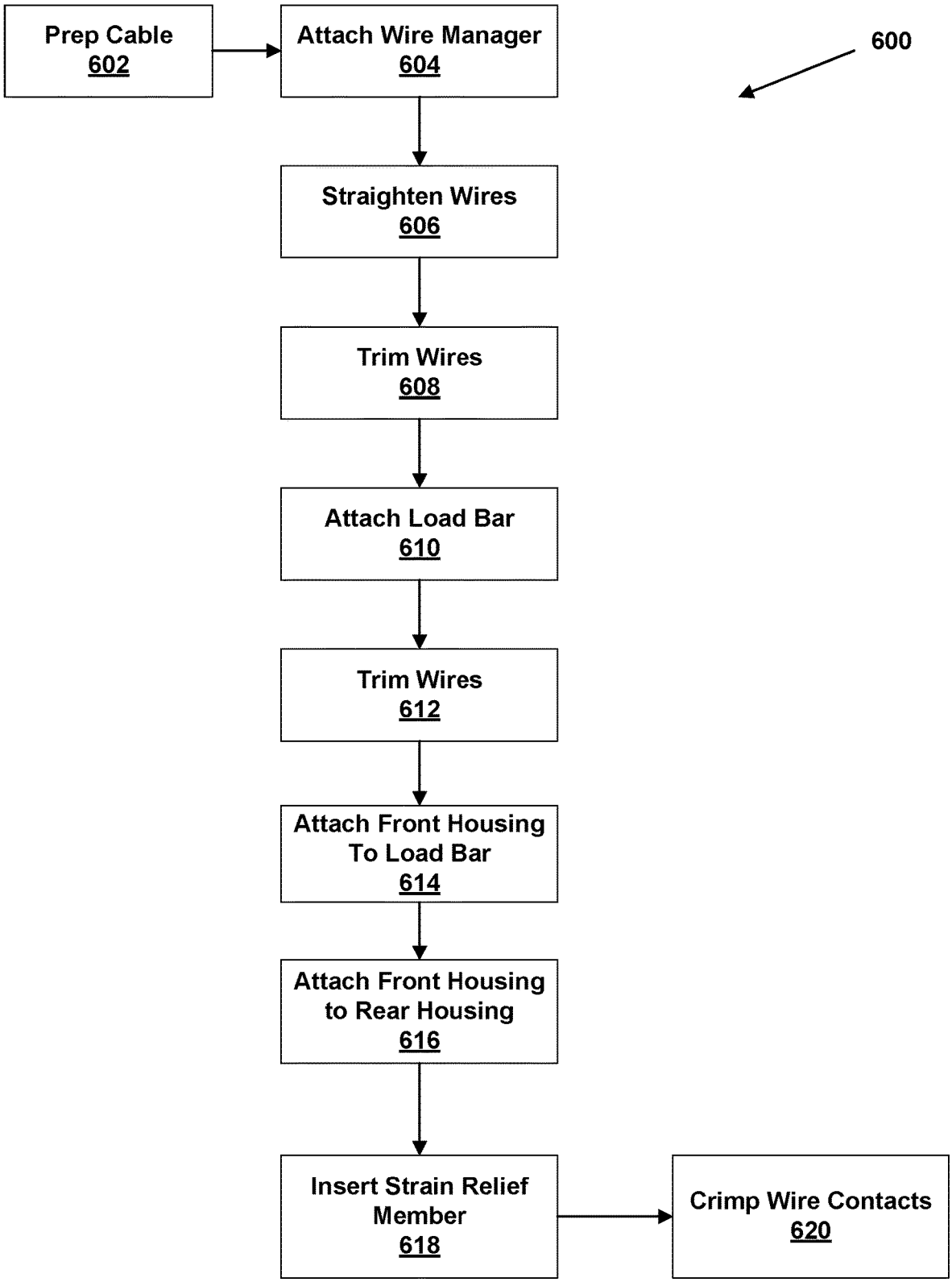
FIG. 28 shows a method of terminating a telecommunications cable with a modular plug.
Figure 29:
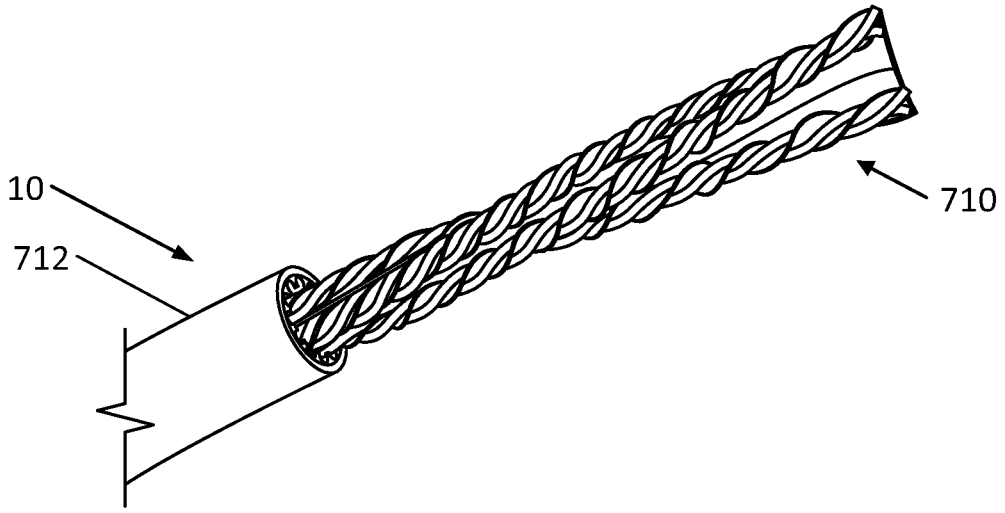
FIG. 29 shows an example preparation of the telecommunications cable.
Figure 30:
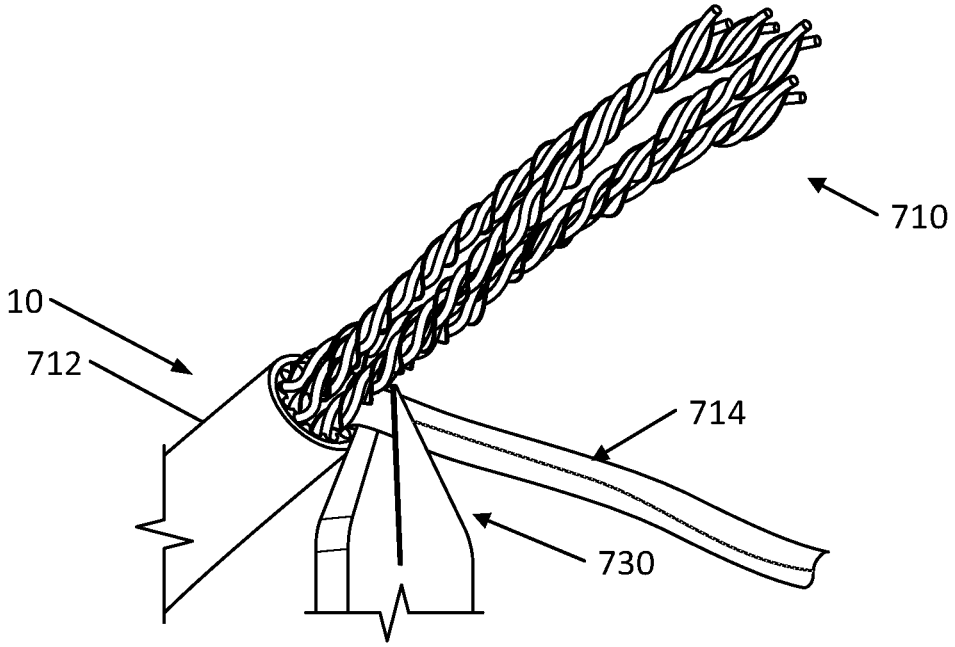
FIG. 30 shows another example preparation of the telecommunications cable.
Figure 31:
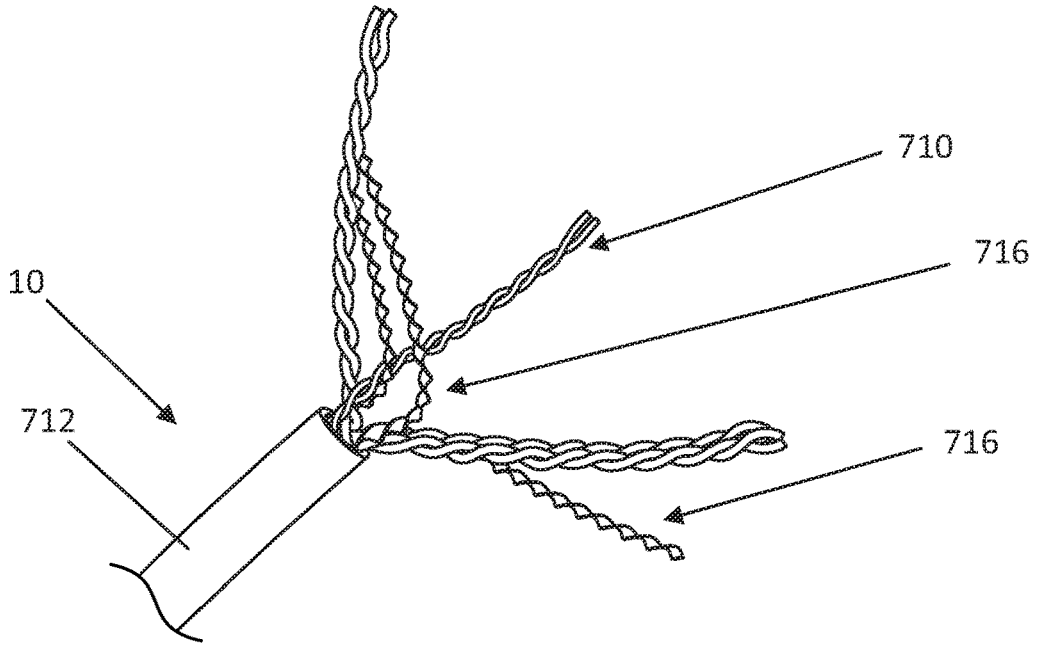
FIG. 31 shows another example preparation of the telecommunications cable.
Figure 32:
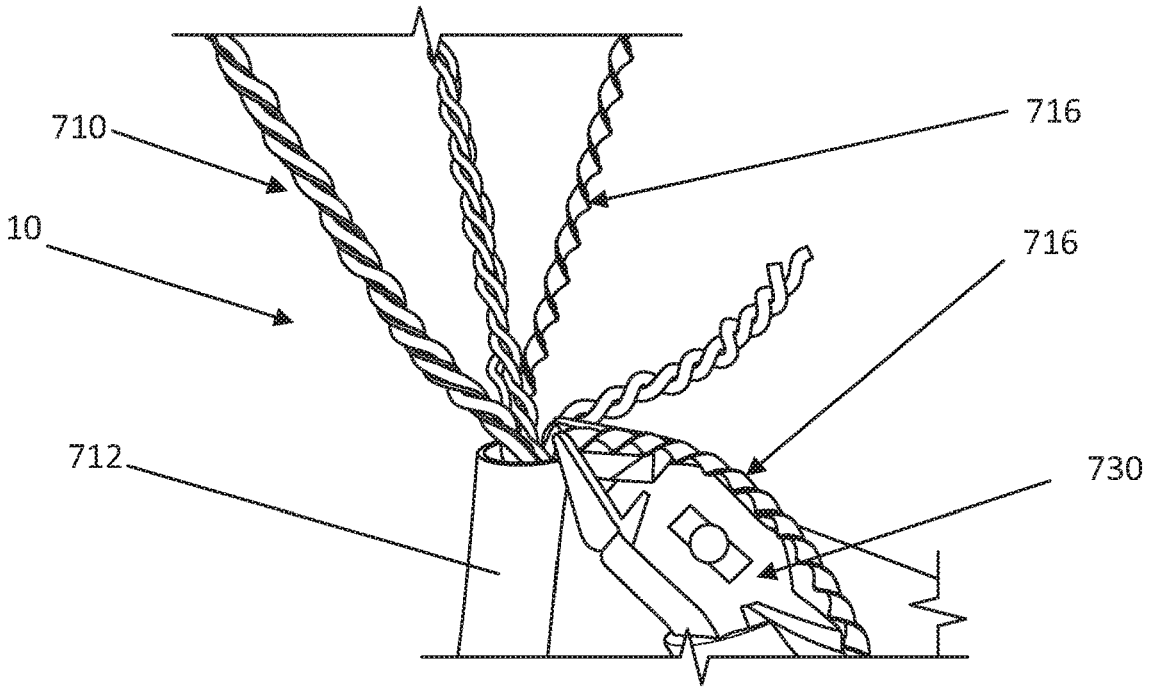
FIG. 32 shows another example preparation of the telecommunications cable.
Figure 33:
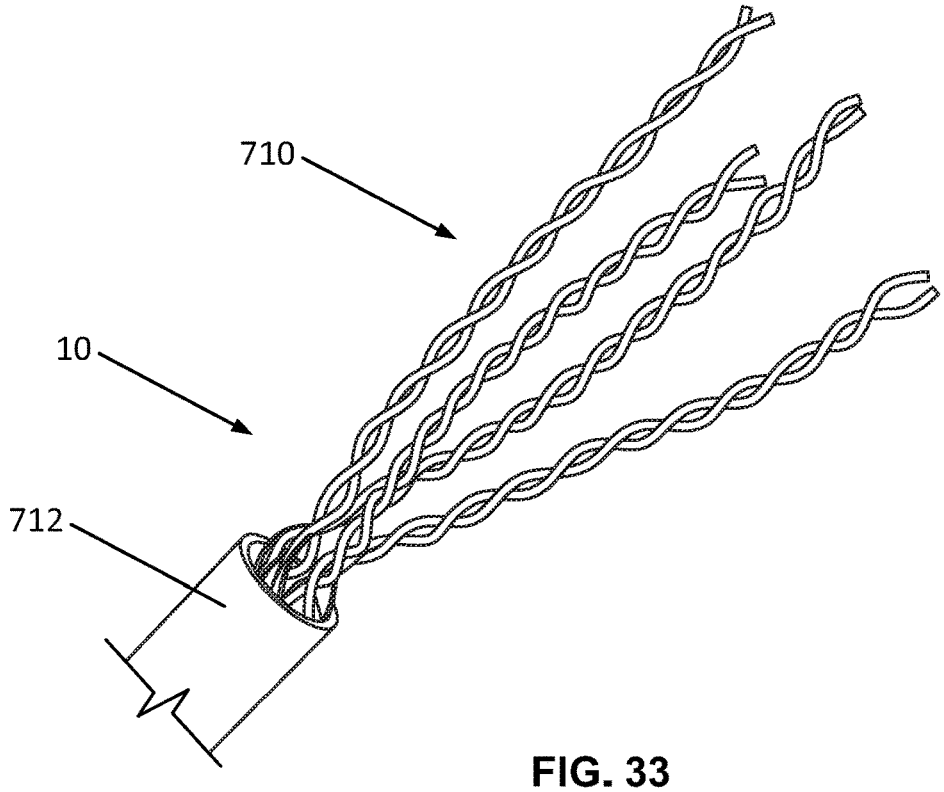
FIG. 33 shows another example preparation of the telecommunications cable.
Figure 34:
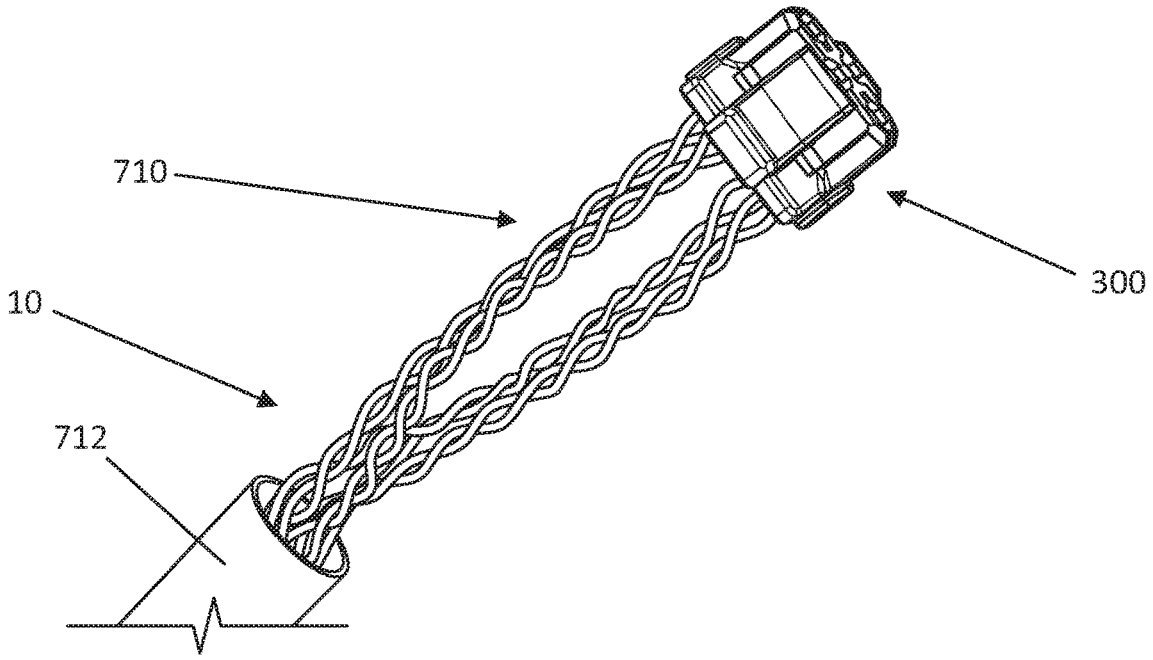
FIG. 34 shows an example wire manager partially attached to twisted pairs of wires at a terminal end of the telecommunications cable.
Figure 35:
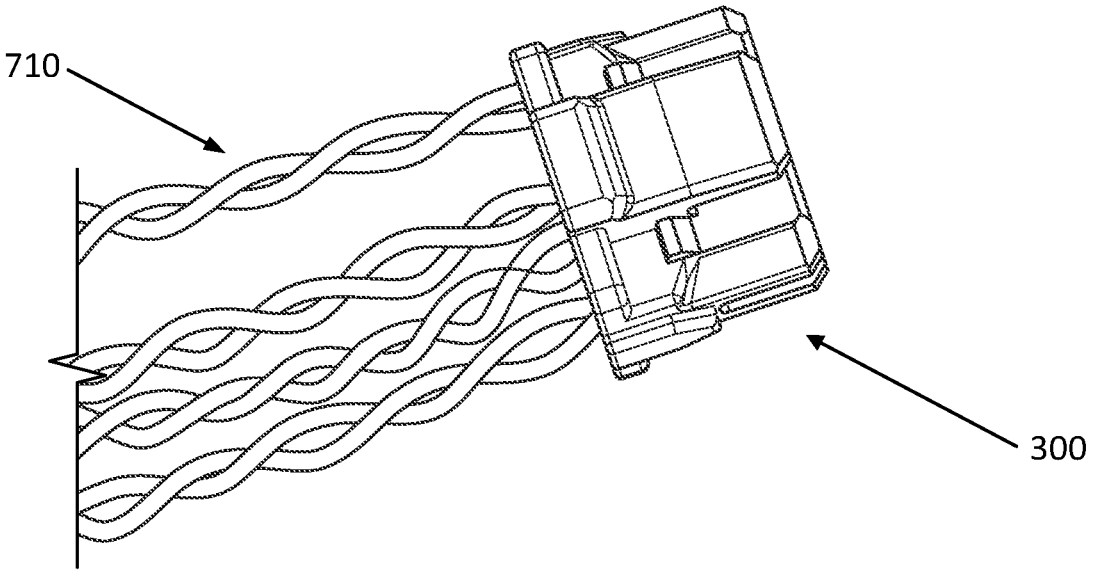
FIG. 35 shows a detailed view of the example wire manager partially attached to twisted pairs of wires at the terminal end of the telecommunications cable.
Figure 36:
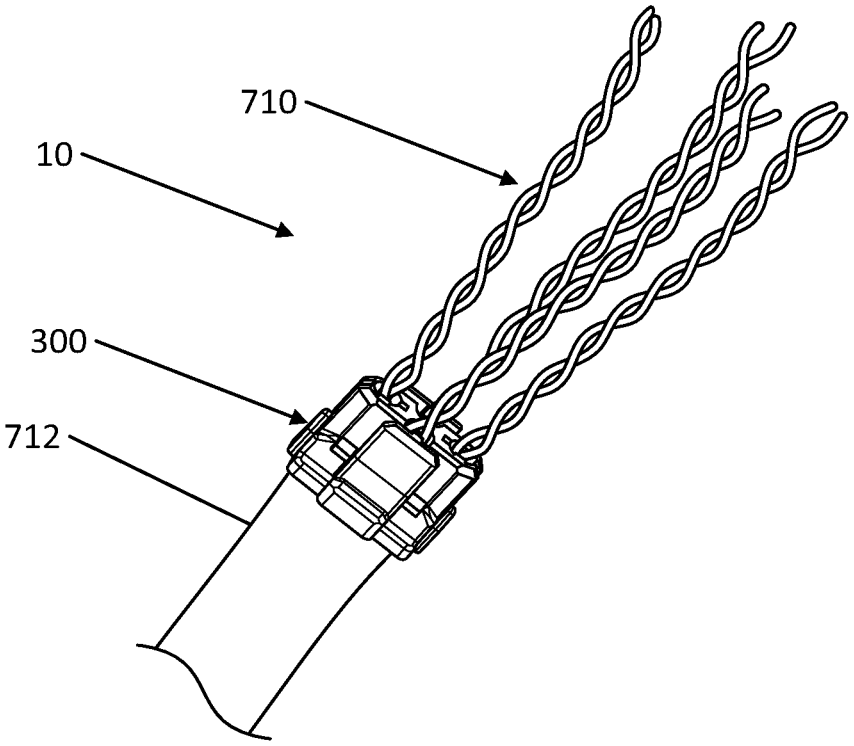
FIG. 36 shows the wire manager attached to the telecommunications cable.
Figure 37:
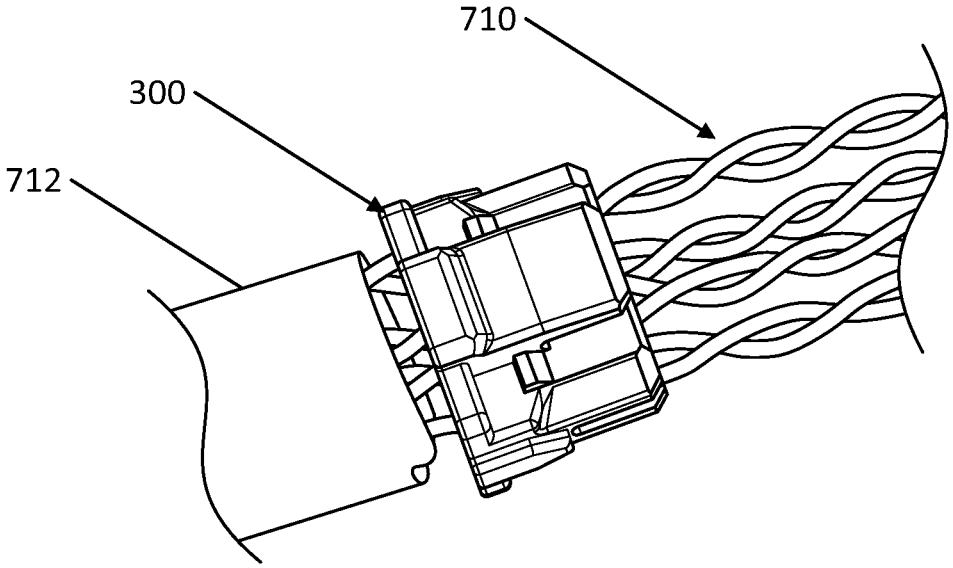
FIG. 37 shows a detailed view of the wire manager attached to the cable.

FIG. 28 illustrates a method 600 of terminating the telecommunications cable 10 with the modular plug 100. The method 600 includes a step 602 of prepping the telecommunications cable 10. FIGS. 29-33 show various stages of preparation. The telecommunications cable 10 includes four pairs of twisted wires 710 housed inside a protective outer jacket 712. Other configurations are possible. Step 602 can include removing a portion of the protective outer jacket 712 at the terminal end of the telecommunications cable 10 to expose the twisted pairs of wires 710 (e.g., see FIG. 29). Step 602 can also include removing one or more internal protective layers such as cross dividers 714 (see FIG. 30) and pair dividers 716 (see FIGS. 31 and 32), and breaking out the twisted pairs of wires 710 at the terminal end of the cable (see FIG. 33). As shown in the figures, a wire cutter 730 may be used to prep the telecommunications cable 10.

Next, the method 600 includes a step 604 of attaching the wire manager 300 to the terminal end of the telecommunications cable 10. FIGS. 34-37 show examples of the wire manager 300 attached to the terminal end of the telecommunications cable 10. As shown in FIGS. 34-37, the wire manager 300 is attached to the telecommunications cable 10 by pushing the twisted pairs of wires 710 through the channels 304 of the wire manager 300.

Figure 38:
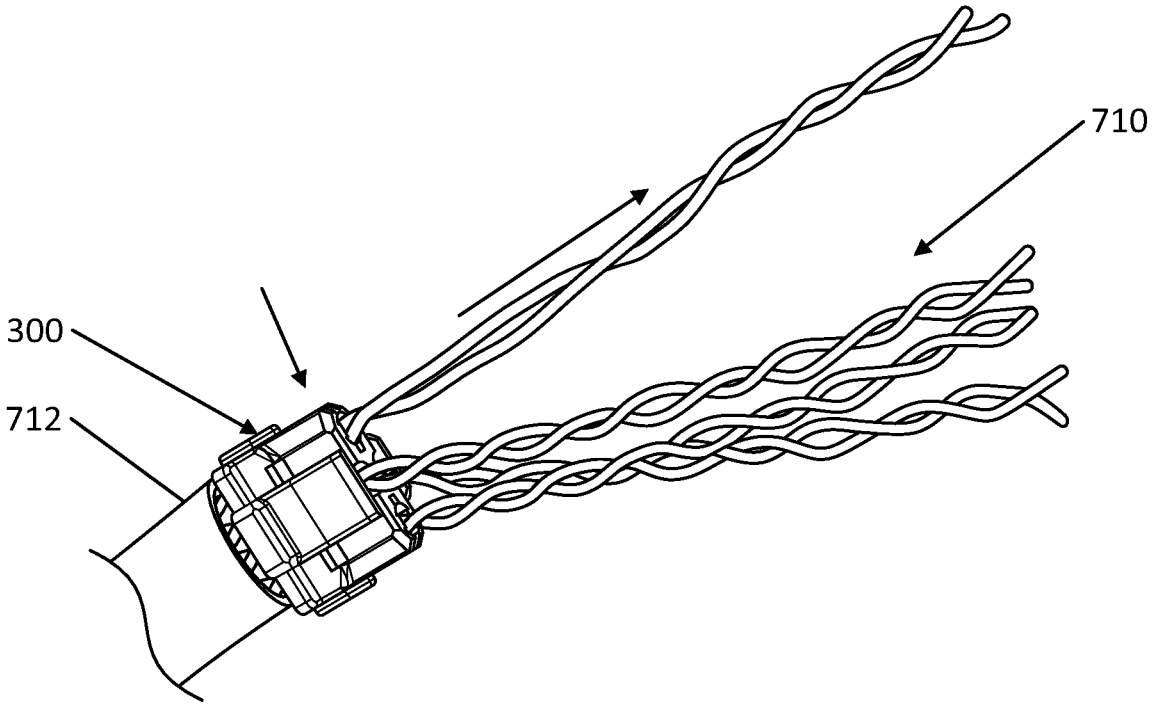
FIG. 38 shows a twisted pair of wires partially straightened.
Figure 39:
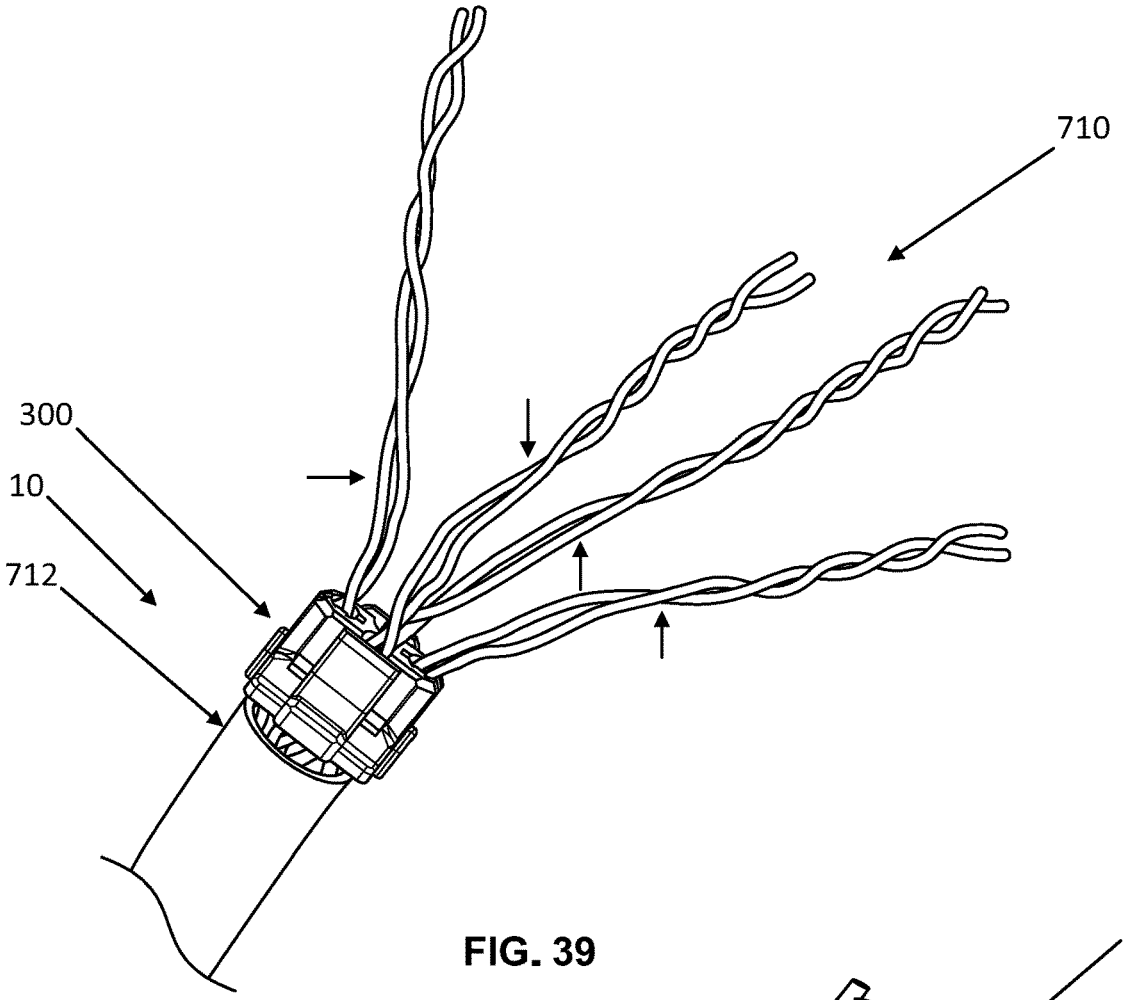
FIG. 39 shows twisted pairs of wires partially straightened.

The method 600 further includes a step 606 of straightening the wires 710. FIGS. 38 and 39 illustrate examples of the wires 710 after they have been straightened. In some examples, the wires can be straightened by hand. In other examples, a tool such as a JacKnack tool can be used to straighten the wires. As described above, the gates 310 can hold the twisted pairs of wires making it easier for a technician to untwist the wires after the wires exit the wire manager 300.

Figure 40:
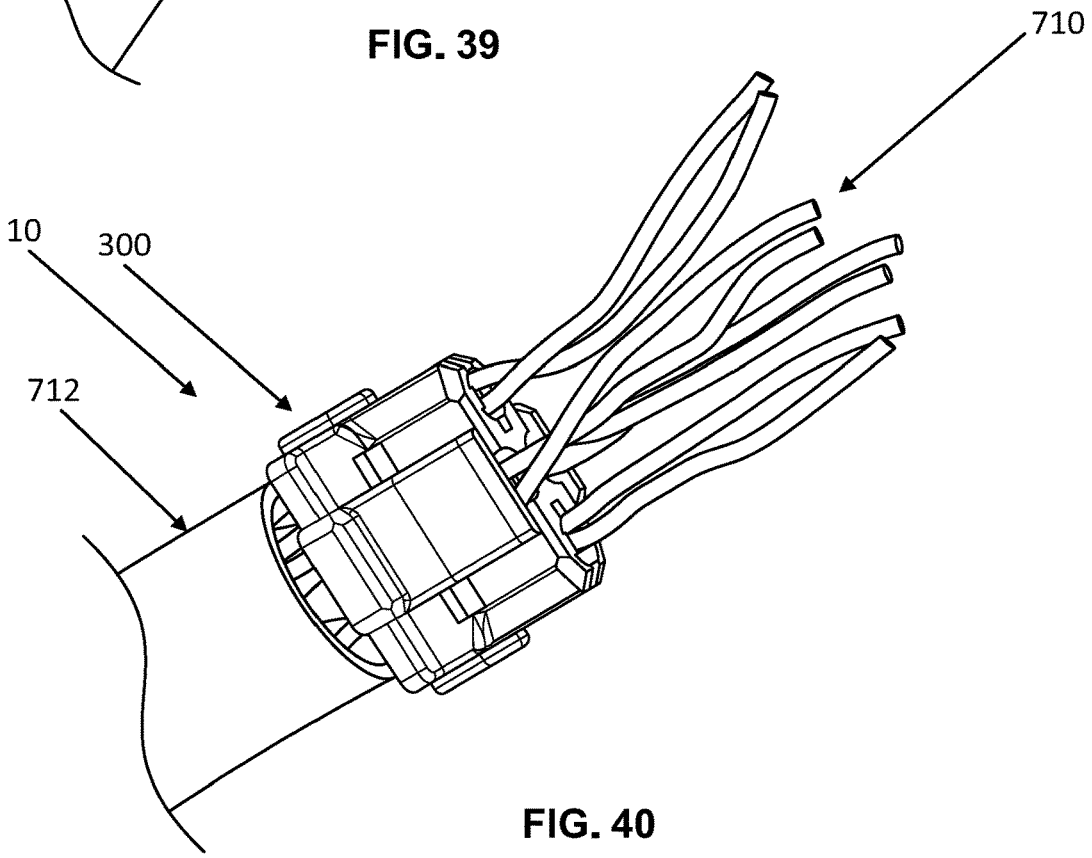
FIG. 40 shows the wires trimmed to have a predetermined length.

Next, the method 600 includes a step 608 of trimming the wires to have a predetermined length that extends outside the wire manager 300. FIG. 40 shows the wires 710 trimmed to have a predetermined length. The wire cutter 730 can be used to trim the wires. In some examples, the wires are trimmed to extend about ½ inch outside the wire manager 300.

Figure 41:
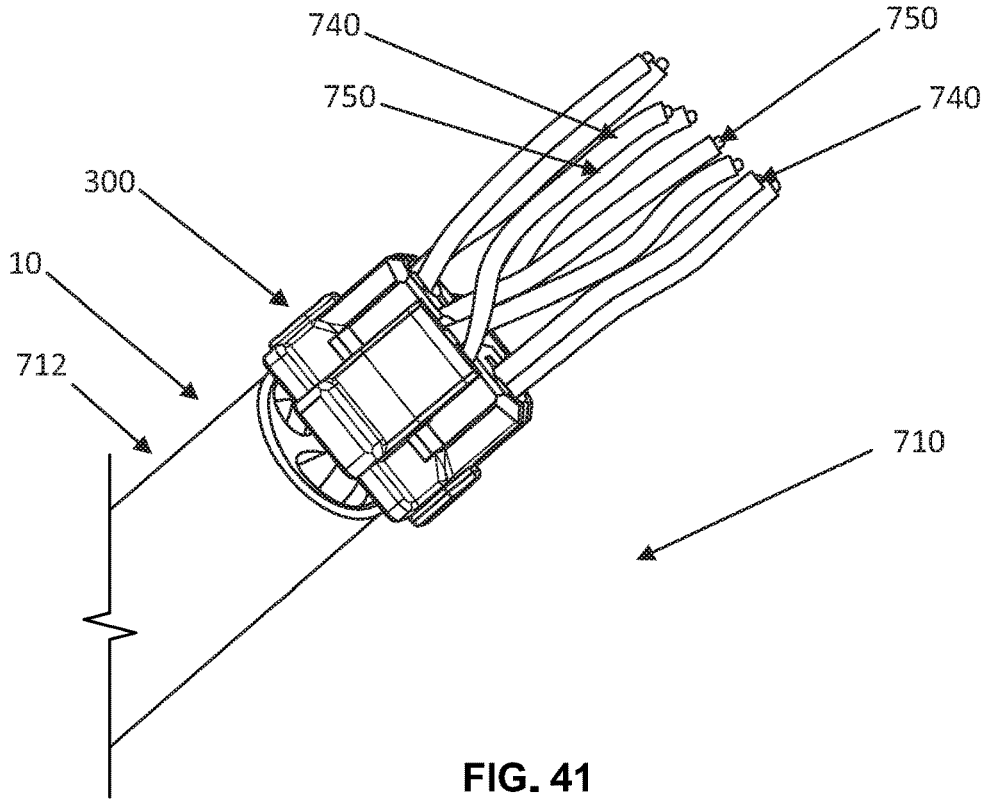
FIG. 41 shows another view of the wires trimmed to have a predetermined length.
Figure 42:
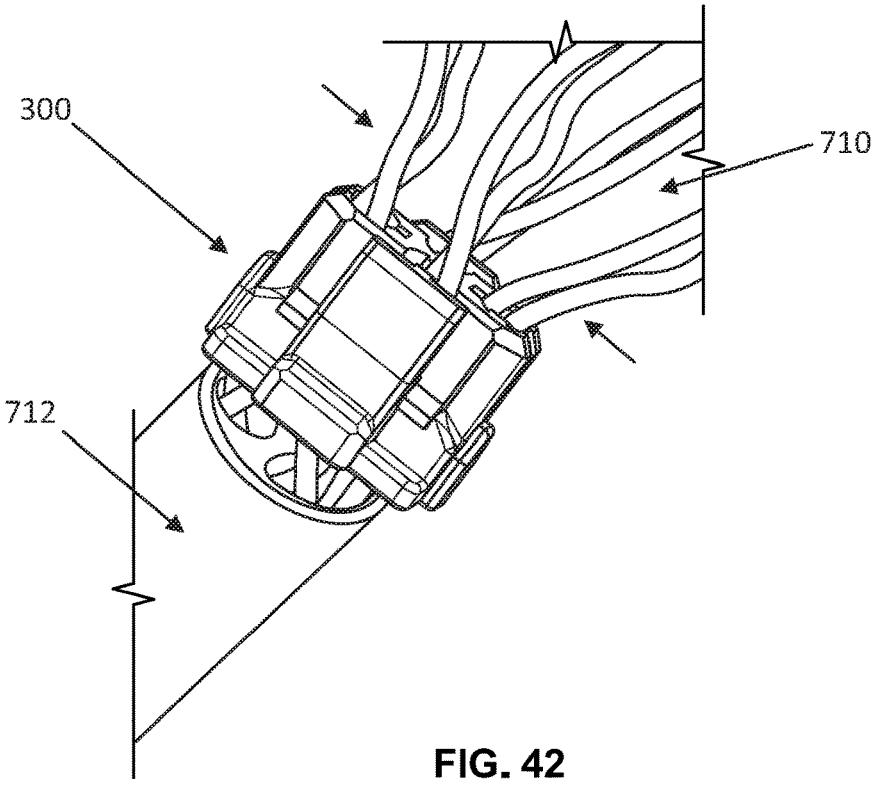
FIG. 42 shows a detailed view of the wires and the wire manager.
Figure 43:
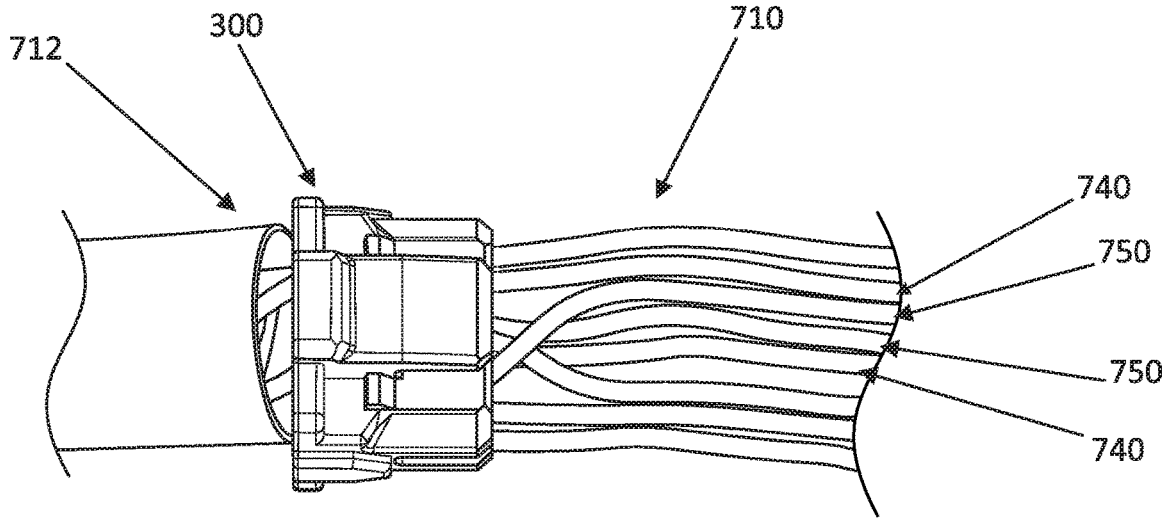
FIG. 43 shows another detailed view of the wires and the wire manager.

FIGS. 41-43 show additional detailed views of the wires 710 exiting the gates of the wire manager 300 after they have been trimmed. As shown in FIGS. 41-43, a twisted pair of green and white wires 740 to go around an adjacent pair of blue and white wires 750.

Figure 44:
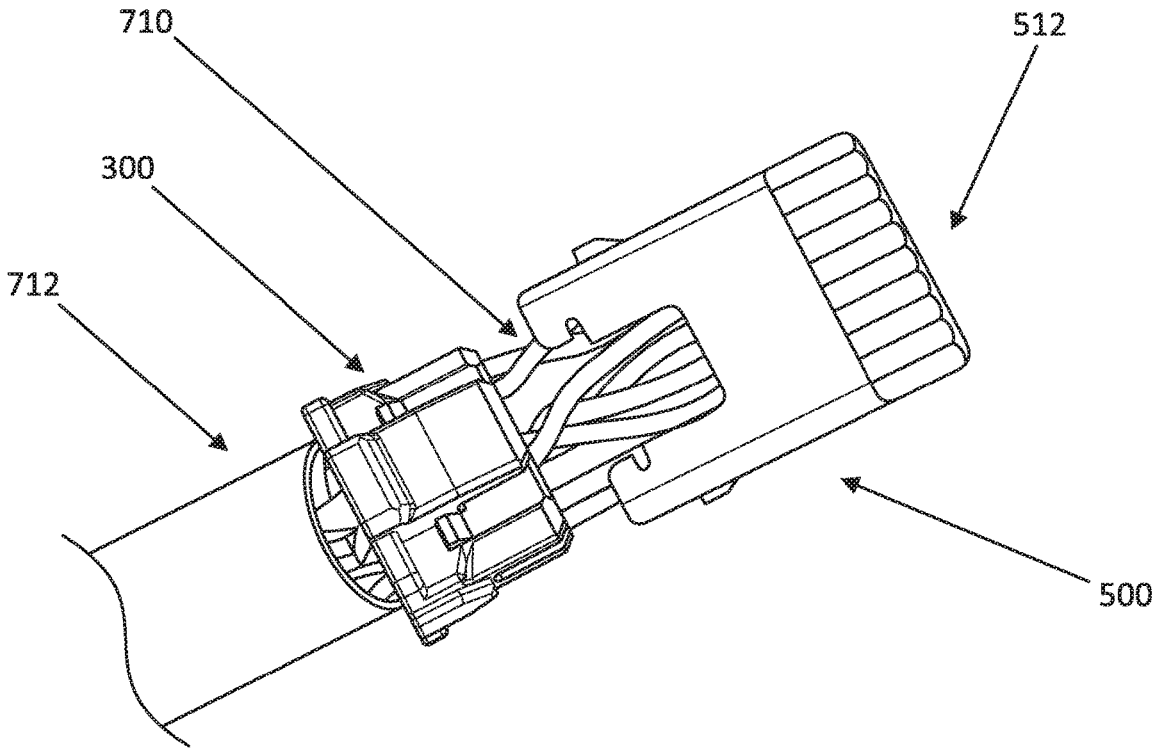
FIG. 44 shows the wires partially slid through the load bar.
Figure 45:
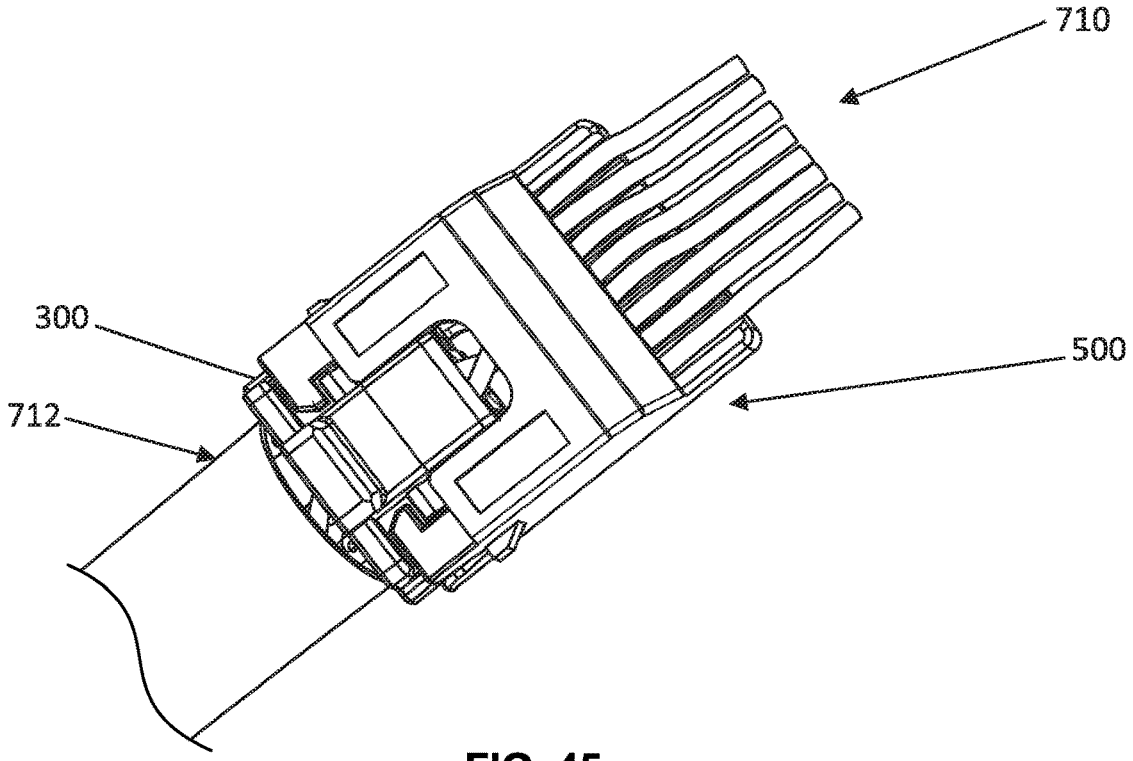
FIG. 45 shows the load bar attached to the wire manager.

Next, the method 600 includes a step 610 of sliding the load bar 500 onto the wires 710 and attaching the load bar 500 to the wire manager 300. FIG. 44 shows the wires partially slid through the load bar 500, and FIG. 45 shows the load bar 500 attached to the wire manager 300. As described above, the load bar 500 is configured to snap-fit onto the wire manager 300.

Figure 46:
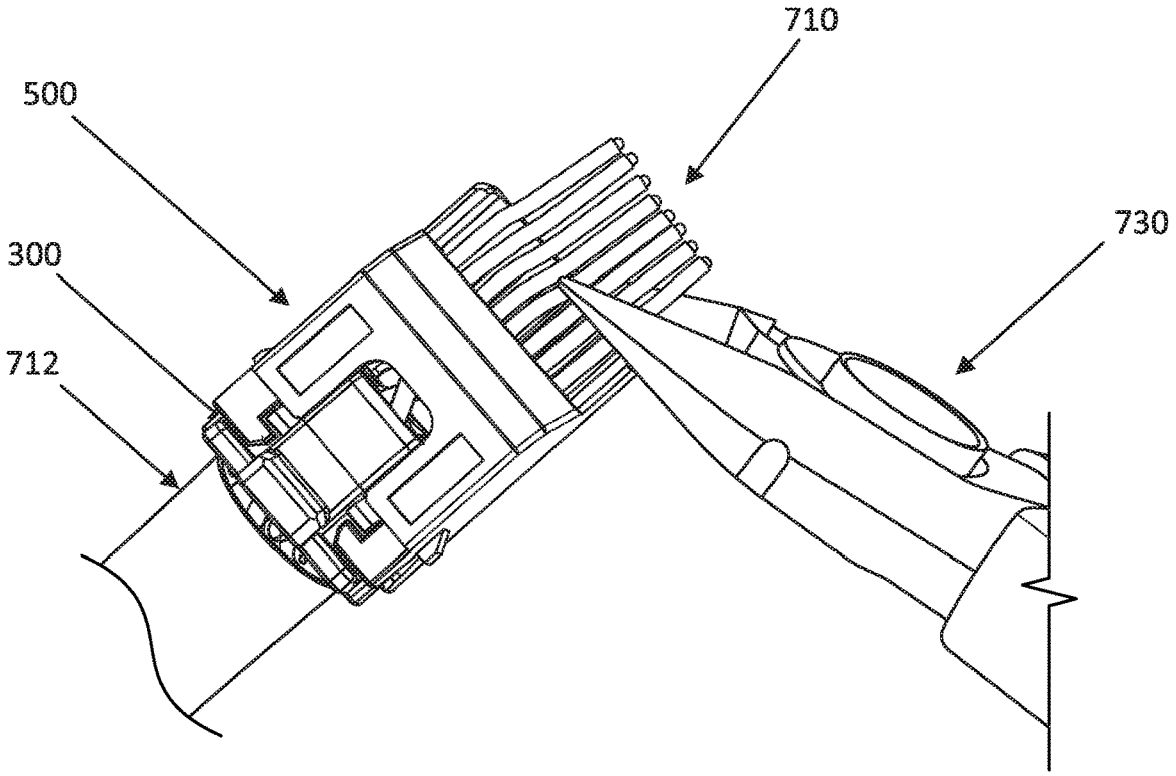
FIG. 46 shows a wire cutter being used to trim the wires.
Figure 47:
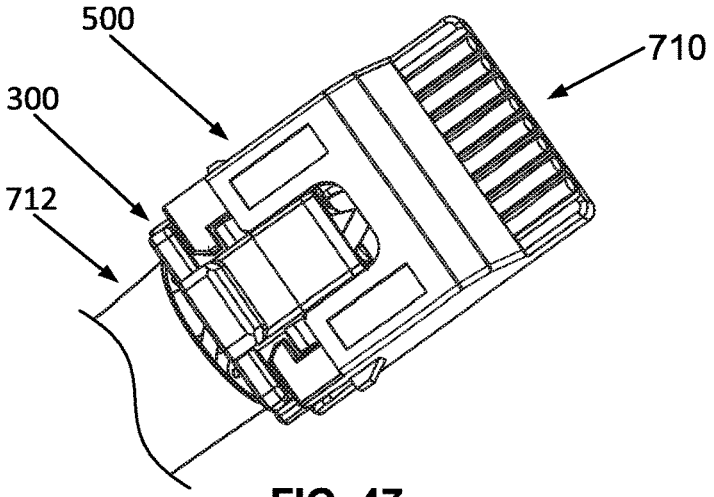
FIG. 47 shows another view of the wires flush with the distal end of the load bar.

Next, the method 600 includes a step 612 of trimming the wires to be flush with the distal end of the load bar 500. FIG. 46 shows wire cutter 730 being used to trim the wires 710. FIG. 47 shows the wires 710 flush with the distal end of the load bar 500.

Figure 48:
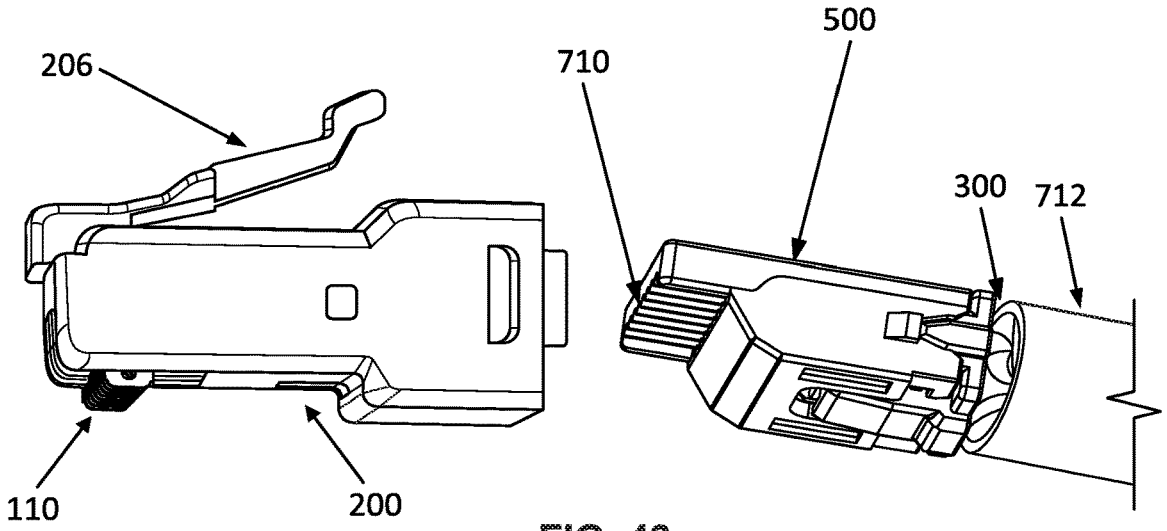
FIG. 48 shows the housing and the load bar.
Figure 49:
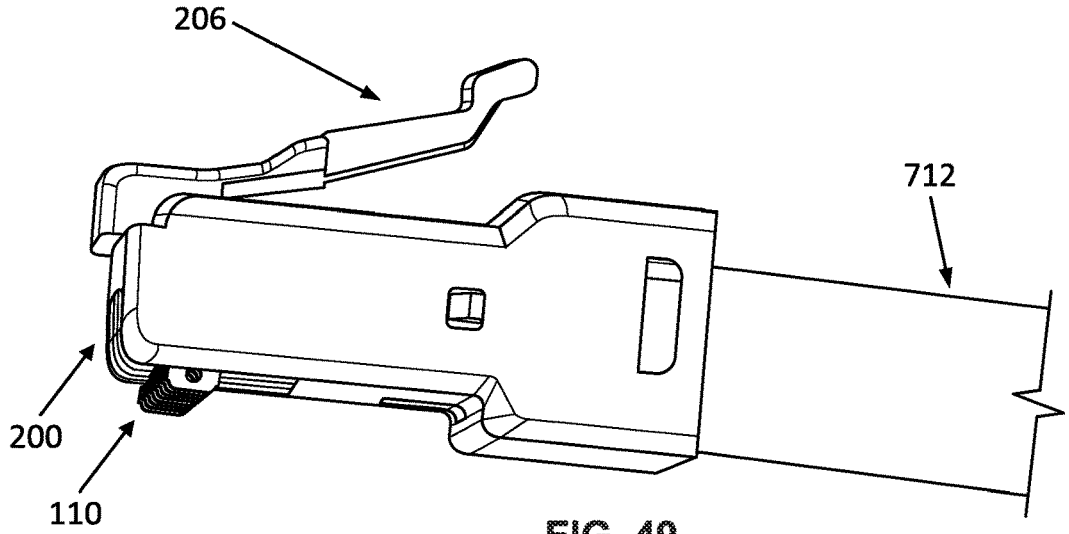
FIG. 49 shows the housing attached to the load bar.

Next, the method 600 includes a step 614 of attaching the housing 200 to the load bar 500. The housing 200 snap-fits onto the load bar 500. FIG. 48 shows the housing 200 and the load bar 500 side by side. FIG. 49 shows the housing 200 attached to the load bar 500.

The method 600 may include a further step 616 of attaching the housing 200 to the rear component 400. As described above, the housing 200 snap-fits onto the rear component 400.

Additionally, the method 600 may include a step 618 of inserting the strain relief member 414 into the rear component 400. When the strain relief member 414 is pushed downward through the opening 408, the strain relief member 414 applies a compression force onto the protective outer jacket of the telecommunications cable 10 to securely lock the rear component 400 onto the terminal end of the telecommunications cable 10.

Figure 50:
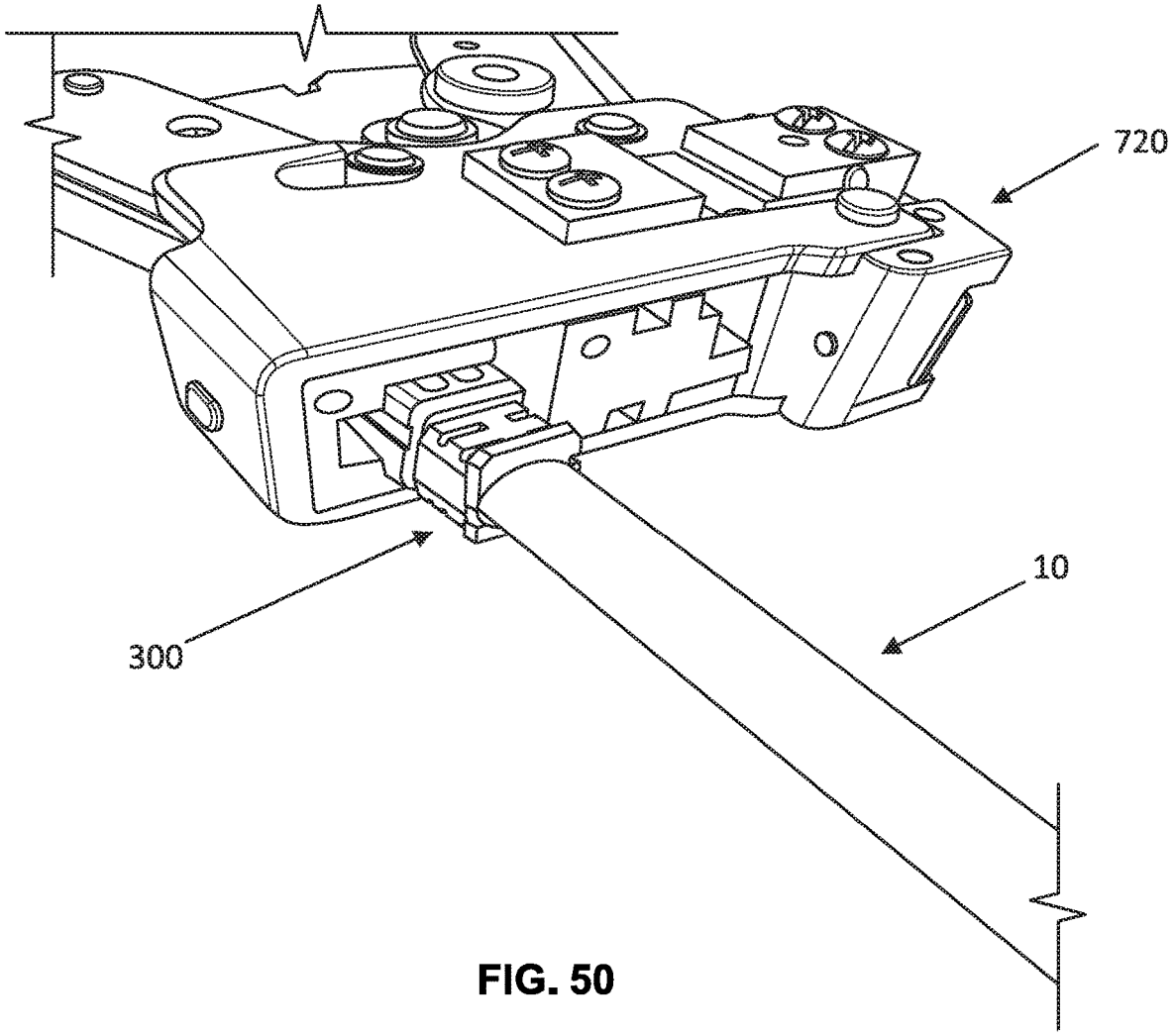
FIG. 50 shows a crimping tool being used to crimp the wire contacts of the modular plug.

Next, the method 600 includes a step 620 of crimping the wire contacts 110 housed inside the housing 200 to contact the wires positioned by the load bar 500. FIG. 50 shows a crimping tool 720 used to crimp the wire contacts 110 into the wires positioned by the load bar 500.

The various embodiments described above are provided by way of illustration only and should not be construed to limit the claims attached hereto. Those skilled in the art will readily recognize various modifications and changes that may be made without following the example embodiments and application illustrated and described herein, and without departing from the true spirit and scope of the following claims.

What is claimed is:

1. A modular plug for terminating a telecommunications cable comprising:

a housing having an internal cavity;

a wire manager fitted inside the internal cavity, the wire manager having a body defining a plurality of channels axially positioned about a central axis, each channel being configured to receive a twisted pair of wires from a telecommunications cable, and each channel having a first width and a gate having a second width smaller than the first width, each channel and respective gate extending in a direction parallel to the central axis, and each gate being configured to hold a twisted pair of wires from the telecommunications cable about the central axis;

a load bar fitted within the internal cavity of the housing, the load bar having an array of external grooves, each external groove being configured to receive a wire from one of the twisted pairs of wires that passes through one of the gates of the wire manager; and a plurality of wire contacts aligned with the array of external grooves.

2. The modular plug of claim 1, wherein each gate includes opposing sloped surfaces that are angled in converging directions with respect to the central axis.

3. The modular plug of claim 2, wherein each gate further includes opposing parallel surfaces that are substantially parallel to the central axis.

4. The modular plug of claim 1, wherein the second width of each gate is equal to or less than the diameter of a single wire from each twisted pair of wires.

5. The modular plug of claim 1, wherein each gate is configured to hold a twisted pair of wires from the telecommunications cable in a stacked horizontal arrangement.

6. The modular plug of claim 1, wherein each channel includes at least one slit that permits each channel to flex around a twisted pair of wires.

7. The modular plug of claim 1, wherein the wire manager includes tabs configured to latch onto corresponding notches on the load bar.

8. The modular plug of claim 1, wherein the wire manager includes four channels.

9. The modular plug of claim 1, wherein each channel has a circular cross-section.

10. The modular plug of claim 1, wherein the load bar includes an internal cavity having a top surface and a bottom surface that converge into the array of external grooves.

11. The modular plug of claim 10, wherein the top surface and the bottom surface each include internal grooves that funnel into the array of external grooves.

12. The modular plug of claim 1, wherein the array of external grooves on the load bar are parallel and are arranged in the same vertical plane.

13. The modular plug of claim 1, wherein the load bar includes tabs configured to snap-fit into corresponding slots in the housing.

14. The modular plug of claim 1, further comprising a rear component configured to fit around a protective outer jacket of the telecommunications cable and to attach to the housing, the rear component having tabs configured to snap-fit into corresponding slots in the housing.

15. The modular plug of claim 14, wherein the rear component further includes:

an opening;

internal surfaces having at least one internal ratcheting rib; and a strain relief member having a base, sides extending from the base, and external ratcheting ribs positioned on each side, the strain relief member being configured to fit through the opening, engage the internal ratcheting ribs on the internal surfaces, and apply a compression force on the protective outer jacket of the telecommunications cable.

16. The modular plug of claim 15, wherein the sides of the strain relief member being configured to fit around the protective outer jacket of the telecommunications cable.

17. The modular plug of claim 15, wherein the base of the strain relief member has a form factor corresponding to the shape of the protective outer jacket of the telecommunications cable.

18. The modular plug of claim 15, wherein the rear component further includes apertures, each aperture configured to receive a distal end of each side of the strain relief member.

19. The modular plug of claim 15, wherein the rear component includes an arm configured to prevent a latching handle from being snagged.

20. A telecommunications cable terminated by the modular plug of claim 1.

21. A modular plug for terminating a telecommunications cable comprising:

a housing having an internal cavity;

a wire manager fitted inside the internal cavity, the wire manager having a body defining a plurality of channels axially positioned about a central axis, each channel being configured to receive a twisted pair of wires from a telecommunications cable, and each channel having a first width and a gate having a second width smaller than the first width;

a load bar fitted within the internal cavity of the housing, the load bar having an array of external grooves, each external groove being configured to receive a wire, the load bar including an internal cavity having a top surface and a bottom surface that converge into the array of external grooves; and a plurality of wire contacts aligned with the array of external grooves.

22. The modular plug of claim 21, wherein the top surface and the bottom surface each include internal grooves that funnel into the array of external grooves.

23. A modular plug for terminating a telecommunications cable comprising:

a housing having an internal cavity;

a wire manager fitted inside the internal cavity, the wire manager having a body defining a plurality of channels axially positioned about a central axis, each channel being configured to receive a twisted pair of wires from a telecommunications cable, and each channel having a first width and a gate having a second width smaller than the first width;

a load bar fitted within the internal cavity of the housing, the load bar having an array of external grooves, each external groove being configured to receive a wire;

a plurality of wire contacts aligned with the array of external grooves; and a rear component configured to fit around a protective outer jacket of the telecommunications cable and to attach to the housing, the rear component having tabs configured to snap-fit into corresponding slots in the housing, and the rear component further includes an opening; internal surfaces having at least one internal ratcheting rib; and a strain relief member having a base, sides extending from the base, and external ratcheting ribs positioned on each side, the strain relief member being configured to fit through the opening, engage the internal ratcheting ribs on the internal surfaces, and apply a compression force on the protective outer jacket of the telecommunications cable.

24. The modular plug of claim 23, wherein the sides of the strain relief member are configured to fit around the protective outer jacket of the telecommunications cable.

25. The modular plug of claim 23, wherein the base of the strain relief member has a form factor corresponding to the shape of the protective outer jacket of the telecommunications cable.

26. The modular plug of claim 23, wherein the rear component further includes apertures, each aperture configured to receive a distal end of each side of the strain relief member.

27. The modular plug of claim 23, wherein the rear component includes an arm configured to prevent a latching handle from being snagged.

* * * * *